United States Patent [19]

Rule

[11] 4,025,341

[45] May 24, 1977

[54] PHOTOCONDUCTIVE POLYMER AND PHOTOCONDUCTIVE COMPOSITIONS AND ELEMENTS CONTAINING SAME

[75] Inventor: Norman G. Rule, Rochester, N.Y.

[73] Assignee: Eastman Kodak Company, Rochester, N.Y.

[22] Filed: Dec. 20, 1974

[21] Appl. No.: 534,980

[52] U.S. Cl. ..... 96/1.6; 96/1.5; 260/65

[51] Int. Cl.[2] ..... G03G 5/09

[58] Field of Search ..... 96/1.6, 1.5; 260/65

[56] References Cited

UNITED STATES PATENTS

| | | | |
|---|---|---|---|
| 1,895,945 | 1/1933 | Semon | 260/566 |
| 1,939,192 | 12/1933 | Williams | 260/65 X |
| 3,037,861 | 6/1962 | Hoegl et al. | 96/1 |
| 3,163,531 | 12/1964 | Schlesinger | 96/1 |
| 3,240,597 | 3/1966 | Fox | 96/1 |
| 3,244,517 | 4/1966 | Lind | 96/1.5 |
| 3,615,414 | 10/1971 | Light | 96/1.6 |
| 3,770,428 | 11/1973 | Watarai | 96/1.5 |

*Primary Examiner*—Mayer Weinblatt
*Attorney, Agent, or Firm*—John R. Everett

[57] ABSTRACT

A photoconductive polymer, and photoconductive insulating compositions and elements containing the same, are disclosed. The aforementioned polymer is a condensation product, preferably of relatively low molecular weight, of certain tertiary aromatic amines and certain carbonyl-containing compounds.

20 Claims, No Drawings

PHOTOCONDUCTIVE POLYMER AND PHOTOCONDUCTIVE COMPOSITIONS AND ELEMENTS CONTAINING SAME

FIELD OF THE INVENTION

This invention relates to a polymer exhibiting photoconductive properties and to photoconductive insulating compositions and elements containing the same useful in electrophotography.

DESCRIPTION OF THE PRIOR ART

The process of xerography, as disclosed by Carlson in U.S. Pat. No. 2,297,691, employs an electrophotographic element comprising a support material bearing a coating of an insulating material whose electrical resistance varies with the amount of incident electromagnetic radiation it receives during an imagewise exposure. The element, commonly termed a photoconductive element, is first given a uniform surface charge, generally in the dark after a suitable period of dark adaptation. It is then exposed to a pattern of actinic radiation which has the effect of differentially reducing the potential of this surface charge in accordance with the relative energy contained in various parts of the radiation pattern. The differential surface charge or electrostatic latent image remaining on the electrophotographic element is then made visible by contacting the surface with a suitable electroscopic marking material. Such marking material or toner, whether contained in an insulating liquid or on a dry carrier, can be deposited on the exposed surface in accordance with either the charge pattern or discharge pattern as desired. Deposited marking material can then be either permanently fixed to the surface of the sensitive element by known means such as heat, pressure, solvent vapor or the like, or transferred to a second element to which it can similarly be fixed. Likewise, the electrostatic charge pattern can be transferred to a second element and developed there.

Various photoconductive insulating materials have been employed in the manufacture of electrophotographic elements. For example, vapors of selenium and vapors of selenium alloys deposited on a suitable support and particles of photoconductive zinc oxide held in a resinous, film-forming binder have found wide application in present-day, document-copying processes.

Since the introduction of electrophotography, a great many organic compounds, both monomers and polymers, have also been screened for their photoconductive properties. As a result, a very large number of organic compounds are known to possess some degree of photoconductivity. Many organic compounds have revealed a useful level of photoconduction and have been incorporated into photoconductive compositions. Among the polymeric, organic, photoconductive materials which have been disclosed are the high-molecular-weight polymers or resins prepared by the condensation of a saturated aliphatic aldehyde with a primary aromatic amine, such as aniline, as described in Lind, U.S. Pat. No. 3,224,517 issued Apr. 5, 1966; the high-molecular-weight polymers or resins prepared by the condensation of certain aromatic, including aromatic heterocyclic, amines with the unsaturated aldehyde, acrolein, or an alkyl-substituted acrolein as described in Schlesinger, U.S. Pat. No. 3,163,531 issued Dec. 29, 1964; the low-molecular-weight condensation polymers prepared by the condensation of formaldehyde or paraformaldehyde with certain polynuclear aromatic monomers, such as anthracene or N-alkyl carbazole, as described in Fox, U.S. Pat. No. 3,240,597 issued Mar. 15, 1966; the condensation polymers prepared by the condensation of n-beta-chloroethyl carbazole with formaldehyde or paraformaldehyde as described in Watarai et. al., U.S. Pat. No. 3,770,428 issued Nov. 6, 1973; and the poly(vinylcarbazole) polymers as described in Hoegl et.al., U.S. Pat. No. 3,037,861 issued June 5, 1962. To date, the applicant's knowledge, only one of the aforementioned polymeric photoconductive materials, namely the poly(vinylcarbazole) polymers, has been successful in the sence that it has been employed commercially.

Optically clear, organic photoconductor-containing elements having desirable electrophotographic properties can be especially useful in electrophotography. Such electrophotographic elements can be exposed through a transparent base if desired, thereby providing flexibility in equipment design. Such compositions, when coated as a film or layer on a suitable support, also yield an element which is reusable; that is, it can be used to form subsequent images after residual toner from prior images has been removed by transfer and/or cleaning. Thus far, the selection of various organic materials for incorporation into photoconductive compositions to form electrophotographic layers has generally proceeded on an empirical material-by-material selection basis.

Recently, an especially useful "multi-active," photoconductive insulating composition has been developed which contains a charge-generation layer in electrical contact with a charge-transport layer, the charge-generation layer comprising a multi-phase "aggregate" composition having a continuous, polymeric phase and dispersed in the continuous phase a cocrystalline complex of (i) a pyrylium-type dye salt, such as a 2,4,6-substituted thiapyrylium dye salt, and (ii) a polymer having an alkylidene diarylene group as a repeating unit, and the charge-transport layer comprising an organic photoconductive charge-transport material. When a uniform-polarity electrostatic charge is applied to the surface of this multi-active element and the charge-generation layer thereof is subjected to an imagewise exposure to activating radiation, the charge-generation layer generates charge carriers, i.e., electron-hole pairs, and injects them into the charge-transport layer which accepts and transports these charge carriers through the multi-active element to form an electrostatic charge pattern at or near the surface of the multi-active element corresponding to the imagewise exposure. The above-described, multi-active element is described in Berwick et. al., copending U.S. Pat. application Ser. No. 534,979, filed concurrently herewith.

Although a number of organic photoconductive materials have been found useful as charge-transport materials in the aforementioned multi-active elements, effort has recently been directed to the problem of finding polymeric, organic, photoconductive materials useful as charge-transport materials in order to obtain a resultant multi-active element exhibiting both a high level of electrophotographic speed and improved mechanical-and environmental-stability properties in comparison with a multi-active element containing monomeric organic charge-transport materials. In this regard, various organic, polymeric materials are known such as those noted in the patents referenced above, but it has been found that these materials (although useful as charge-transport materials in the aforementioned multiactive elements), are generally incapable of providing a resultant, multi-active, photoconductive insulating element exhibiting both high levels of electrophotographic speed and improved mechanical- and environmental-stability properties.

SUMMARY OF THE INVENTION

In accord with the present invention certain new photoconductive polymers, as well as photoconductive insulating compositions and electrophotographic elements comprising the same, are provided. The photoconductive polymers of the invention are condensation products, advantageously (but not necessarily) of relatively low molecular weight, of (a) a tertiary amine having at least two phenyl groups, including substituted phenyl groups, bonded to the amine nitrogen atom and (b) a carbonyl-containing compound having the formula:

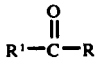

I.

wherein:

$R^1$ represents hydrogen, an alkyl group or an aryl group, including substituted alkyl and aryl groups, R represents an alkyl or aryl group as defined above, and $R^1$ and R, when taken together, represent the saturated carbon atoms necessary to complete a cycloalkyl group, including substituted cycloalkyl groups, containing 3 to about 21 carbon atoms in the cycloalkyl ring.

In accord with one embodiment of the invention, the above-described photoconductive polymers have been found highly useful as p-type, organic, photoconductive charge-transport materials in the charge-transport layer of a multi-active, photoconductive insulating element of the type described above.

In accord with another embodiment of the invention, it has been found that one or more of the polymeric materials of the invention may be employed as an organic photoconductor in a "non-aggregate-containing" photoconductive composition, for example, a homogeneous organic photoconductive composition comprising a solid solution of one or more of the polymeric materials of the invention and an electrically insulating, film-forming, polymeric binder.

In accord with another embodiment of the present invention, it has been discovered that one or more of the polymeric materials of the invention may be employed as an organic photoconductor in the continuous polymer phase of a multiphase aggregate photoconductive composition of the type described in Light, U.S. Pat. No. 3,615,414 issued Oct. 26, 1971. The resultant aggregate photoconductive compositions exhibit high electrical speeds, good mechanical properties, such as abrasion resistance, and good environmental stability, such as thermally stability.

Various polymeric materials having a structure somewhat similar to those of the present invention have been described in the art (in addition to the polymeric photoconductive materials described in U.S. Pat. Nos. 3,037,861; 3,247,517; 3,163,531; 3,240,597; and 3,770,428 referred to earlier herein), for example, the polymeric materials described in Semon et al., U.S. Pat. No. 1,895,945 issued Jan. 31, 1933 and Williams U.S. Pat. No. 1,939,192 issued Dec. 12, 1933. However, the particular polymeric materials described in the Semon et. al. and Williams patent are prepared from primary amines, rather than the tertiary aromatic amines used in the present invention, and there is no indication in the Semon and Williams patents of whether or not the particular polymers described therein exhibit any photoconductive properties.

DESCRIPTION OF THE PREFERRED EMBODIMENTS

Representative of the preferred low molecular weight condensation polymers of the invention are polymers having the following formula:

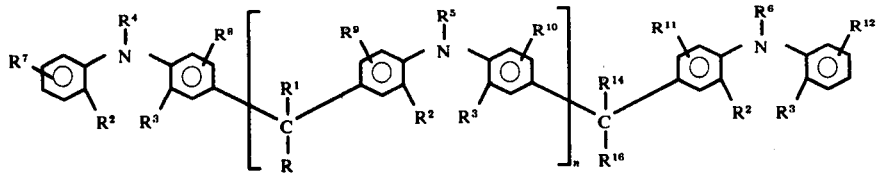

II.

wherein

*n* represents an integer of from 0 to about 20;

$R^2$ and $R^3$ each represent hydrogen or, when taken together, $R^2$ and $R^3$ represent a chemical bond which completes a carbazole nucleus;

$R^4$, $R^5$, and $R^6$, which may be the same or different, each represent an alkyl or aryl group; including a substituted alkyl or aryl group;

$R^7$, $R^8$, $R^9$, $R^{10}$, $R^{11}$, and $R^{12}$, which may be the same or different, each represent hydrogen or an aliphatic, alicyclic, or an aryl group;

$R^1$ and $R^{14}$, which may be the same or different, each represent hydrogen, an alkyl or aryl group, including substituted alkyl and aryl groups;

R and $R^{16}$, which may be the same or different, each represent an alkyl or aryl group, including substituted alkyl and aryl groups; with the proviso that, when taken together, $R^1$ and R or $R^{14}$ and $R^{16}$ represent the saturated carbon atoms necessary to complete a substituted or unsubstituted cycloalkyl group containing 3 to about 21 carbon atoms in the cycloalkyl ring.

Typically, when R, $R^1$, $R^4$, $R^5$, $R^6$, $R^{14}$, or $R^{16}$ represent an alkyl group, it is selected from one of the following alkyl groups:

1. an alkyl group having 1 to about 14 carbon atoms e.g., methyl, ethyl, propyl, butyl, isobutyl, octyl, dodecyl, etc. including a substituted alkyl group having 1 to about 14 carbon atoms such as
   a. alkoxyalkyl, e.g., ethoxypropyl, methoxybutyl, propoxymethyl, etc.,
   b. aryloxyalkyl, e.g., phenoxyethyl, naphthoxymethyl, phenoxypentyl, etc., c. aminoalkyl, e.g., aminobutyl, aminoethyl, aminopropyl, etc.
d. hydroxyalkyl e.g., hydroxypropyl, hydroxyoctyl, etc.,
e. aralkyl e.g., benzyl, phenethyl, etc.
f. alkylaminoalkyl, e.g., methylaminopropyl, methylaminoethyl, etc., and also including dialkylaminoalkyl e.g., diethylaminoethyl, dimethylaminopropyl, propylaminooctyl, etc.,
g. arylaminoalkyl, e.g., phenylaminoalkyl, diphenylaminoalkyl, N-phenyl-N-ethylaminopentyl, N-phenyl-N-ethylaminohexyl, naphthylaminomethyl, etc.,
h. nitroalkyl, e.g., nitrobutyl, nitroethyl, nitropentyl, etc.,
i. cyanoalkyl, e.g., cyanopropyl, cyanobutyl, cyanoethyl, etc., and
j. haloalkyl, e.g., chloromethyl, bromopentyl, chlorooctyl, etc.

Typically, when R, $R^1$, $R^4$, $R^5$, $R^6$, $R^{14}$, or $R^{16}$ represent an aryl group, it is selected from one of the following aryl groups:

1. an aryl group, e.g., phenyl, naphthyl, anthryl, fluorenyl, etc., including a substituted aryl group such as
   a. alkoxyaryl, e.g., ethoxyphenyl, methoxyphenyl, propoxynaphthyl, etc.
   b. aryloxyaryl, e.g., phenoxyphenyl, naphthoxyphenyl, phenoxynaphthyl, etc.
   c. aminoaryl, e.g. aminophenyl, aminonaphthyl, aminoanthryl, etc.
   d. hydroxyaryl, e.g., hydroxyphenyl, hydroxynaphthyl, hydroxyanthryl, etc.
   e. biphenylyl,
   f. alkylaminoaryl, e.g., methylaminophenyl, methylaminonaphthyl, etc. and also including dialkylaminoaryl, e.g., diethylaminophenyl, dipropylaminophenyl, etc.
   g. arylaminoaryl, e.g., phenylaminophenyl, diphenylaminophenyl, N-phenyl-N-ethylaminophenyl, naphthylaminophenyl, etc.
   h. nitroaryl e.g., nitrophenyl, nitronaphthyl, nitroanthryl, etc.,
   i. cyanoaryl, e.g., cyanophenyl, cyanonaphthyl, cyanoanthryl, etc.,
   j. haloaryl, e.g., chlorophenyl, bromophenyl, chloronaphthyl, etc., and
   k. alkaryl, e.g., tolyl, ethylphenyl, propylnaphthyl, etc.

When R and $R^1$ or $R^{14}$ and $R^{16}$ are taken together to form a cycloalkyl group as described hereinbefore, the cycloalkyl ring thereof may, if desired, contain one or more substituents. Typically, the substituents are selected from any of the various substituents noted above which may be attached to an acyclic alkyl group.

As suggested above, $R^7$, $R^8$, $R^9$, $R^{10}$, $R^{11}$, and $R^{12}$ may be selected from a wide variety of known substituents for phenyl groups, the particular one selected not being especially critical. Typically, for simplicity, $R^7$, $R^8$, $R^9$, $R^{10}$, $R^{11}$, and $R^{12}$ represent hydrogen substituents. However, they may also be selected from any of the above-noted alkyl or aryl groups. In addition, $R^7$, $R^8$, $R^9$, $R^{10}$, $R^{11}$, and $R^{12}$ may be selected from any of the following additional aliphatic and aryl groups:

1. an alkoxy group having 1 to about 14 carbon atoms, e.g., methoxy, ethoxy, propoxy, butoxy, etc.;
2. an aryloxy group, e.g., phenoxy, naphthoxy, etc.;
3. halogen such as chlorine, bromine, fluorine, or iodine;
4. nitro groups;
5. cyano groups;
6. amino groups including alkylamino and arylamino groups containing 1 to about 14 carbon atoms; and
7. acyl groups having the formula $$-\overset{\overset{\displaystyle O}{\|}}{C}-R^1$$

wherein $R^1$ is as defined above.

A partial listing of representative photoconductive polymeric materials of the invention are listed in Table 1.

Table 1

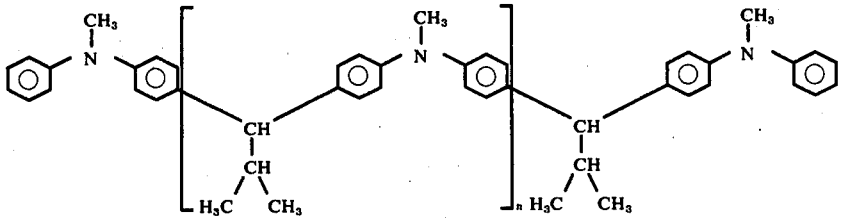

III.

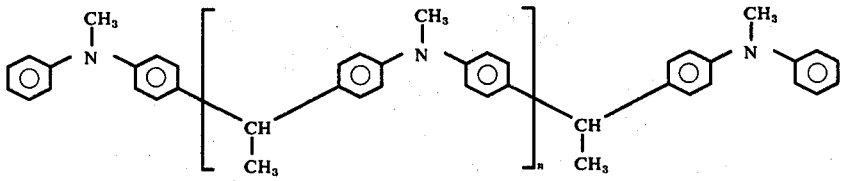

IV.

Table 1-continued

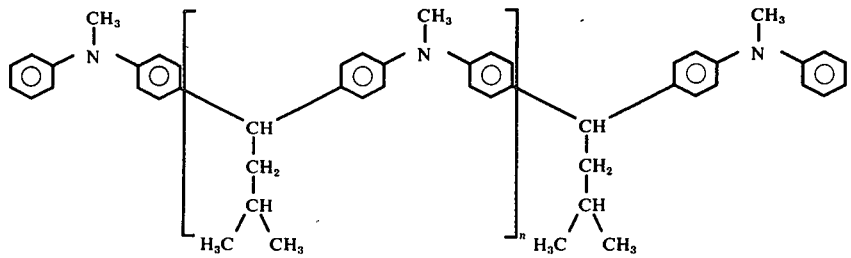

V.

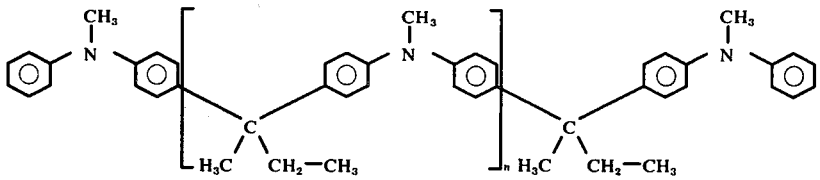

VI.

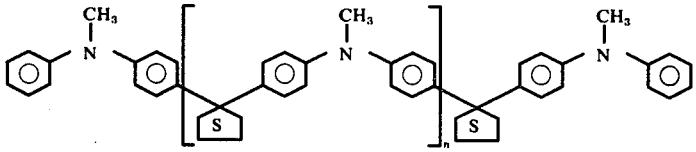

VII.

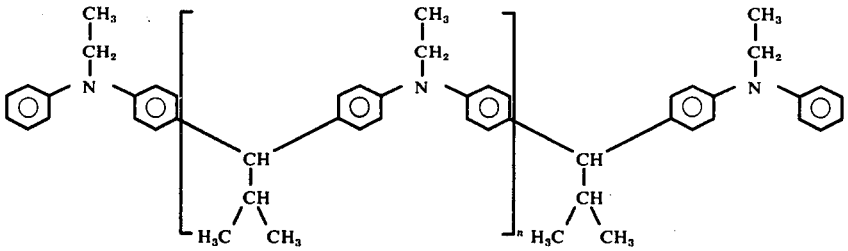

VIII.

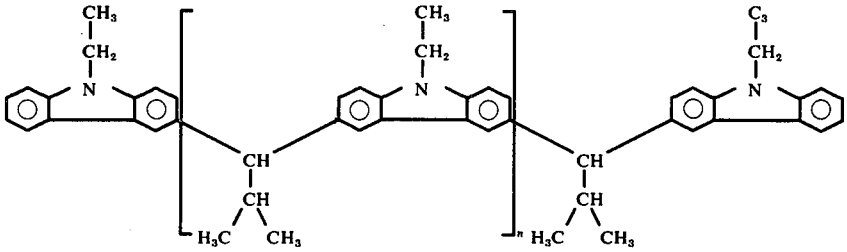

IX.

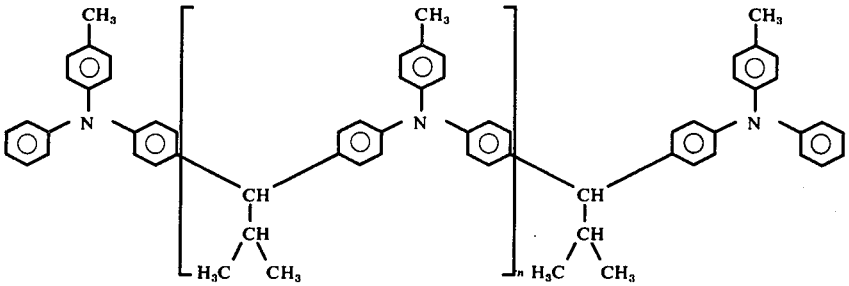

X.

Polymers which belong to the general class of photoconductive polymers described herein and which are preferred for use in accord with the present invention because of their high electrophotographic speed and mechanical- and environmental-stability properties include those polymers having structural formula II shown above wherein R and $R^{16}$ represent unsubstituted alkyl groups having 1 to about 8 carbon atoms; $R^4$, $R^5$, and $R^6$ represent unsubstituted phenyl groups, alkyl-substituted phenyl groups having 1 to about 3 carbon atoms in the alkyl substituent, and unsubstituted alkyl groups having 1 to about 4 carbon atoms in the alkyl group; and $R^1$, $R^2$, $R^3$, $R^7$, $R^8$, $R^9$, $R^{10}$, $R^{11}$, $R^{12}$, and $R^{14}$ represent hydrogen.

As expressed above, the photoconductive polymers of the invention are condensation polymers prepared by the condensation of a tertiary aromatic amine (containing at least two phenyl or substituted phenyl groups joined to the amine nitrogen atom) with a carbonyl-containing compound of the formula

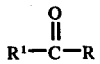

wherein $R^1$ and R are as defined above. The condensation reaction may be carried out by heating approximately equal molar amounts of the tertiary aromatic amine and carbonyl-containing compound in a stirred, acidic, aqueous-alcoholic solution or in a stirred, acetic acid-containing solution at standard pressure conditions. A typical reaction procedure for the preparation of polymer III of Table 1 is set forth hereinafter in greater detail in the examples. Typical tertiary aromatic amines which may be used in the present invention include compounds having the formula:

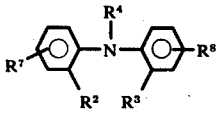

wherein $R^2$, $R^3$, $R^4$, $R^7$, and $R^8$ are as defined earlier herein.

It may be noted that the photoconductive polymers of the invention include (1) polymers prepared by the condensation of a single type of tertiary aromatic amine and a single type of carbonyl-containing compound so that the individual repeating units of the resultant polymer are identical and (2) polymers prepared by the condensation of a mixture of different tertiary aromatic amines and/or a mixture of different carbonyl-containing compounds so that the individual repeating units of the resultant polymer differ from one another.

As indicated, the polymers of the invention advantageously have a low molecular weight, that is, *n* in formula II above represents an integer of 0 to about 20 and preferably from 0 to about 12. Higher-molecular-weight polymers may also be prepared,, however these materials may be less desirable because of their decreased solubility in conventional, organic coating solvents.

The photoconductive polymers of the invention are useful in various photoconductive insulating compositions. These polymers are particularly useful as a p-type, organic, photoconductive charge-transport material in a multi-active photoconductive element as described in Berwick et al, copending U.S. application Ser. No. 534,979, referred to hereinabove and incorporated herein by reference thereto. Such photoconductive elements are unitary, multilayer elements having at least two layers, namely a charge-generation layer in electrical contact with a charge-transport layer. The charge-generation layer is composed of a multiphase aggregate composition of the type described in Light, U.S. Pat. No. 3,615,414. The charge-generation layer, therefore, contains a continuous, electrically insulating, polymer phase and, dispersed in the continuous phase, a discontinuous phase comprising a finely-divided, particulate, co-crystalline complex of (i) at least one polymer having an alkylidene diarylene group in a recurring unit and (ii) at least one pyrylium-type dye salt such as a pyrylium, thiapyrylium, or selenapyrylium dye salt, the thiapyrylium dye salts being especially useful.

The charge-transport layer of the aforementioned multiactive, photoconductive insulating element is free of the particulate, co-crystalline-complex material and the pyrylium-type dye salts described above. Typically, the charge-transport layer contains a film-forming polymer in addtion to one or more charge-transport materials. Preferably, the charge-transport material(s) has a principal radiation absorption band below about 475 nm and is transparent to activating radiation for the charge-generation layer.

The charge-transport layer used in the multi-active element of the present invention comprises an organic material-containing composition. The term "organic", as used herein, refers to both organic and metallo-organic materials.

The above-described, multi-active, photoconductive element may advantageously be employed as a high-speed photoconductive element in a variety of conventional electrophotographic processes. When so used, the particulate, co-crystalline-complex material contained in the charge-generation layer, upon exposure to an imagewise pattern of activating radiation for the complex, e.g., light in the region of from about 520 to about 700 nm, is capable of generating charge carriers, i.e., electron-hole pairs, and, in the presence of a suitable electrical driving force, is capable of injecting such charge carriers, i.e., either the holes or the electrons, into a contiguous charge-transport layer. The charge-transport layer, if it is a p-type transport layer, is capable of accepting the positive charge carriers, i.e., the holes, injected into it by the charge-generation layer and, in the presence of a suitable electrical driving force, is capable of transporting the holes through the transport layer to, for example, the surface thereof where the charge carriers may be used to form a charge pattern corresponding to the original imagewise pattern of activating radiation to which the charge-generation layer was exposed.

When the photoconductive polymers of the present invention are incorporated in a p-type, charge-transport layer of a multi-active photoconductive element of the type described above, the amount of the photoconductive polymer which is employed may vary. For example, the charge-transport layer may consist entirely of the photoconductive polymer of the invention, or the photoconductive polymer of the invention can be admixed with other suitable, p-type, photoconductive charge-transport materials to form useful charge-transport layers. It is generally advantageous to incorporate a film-forming polymer as binder in the charge-transport layer in addition to the photoconductive polymer of the invention. The binder material, if it is electrically insulating as is typically the case, helps to provide the charge-transport layers with appropriate electrical insulating characteristics, and also serves as a film-forming material useful in (a) coating the charge-transport layer, (b) causing the charge-transport layer to adhere to an adjacent substrate, and (c) providing a smooth, easy to clean, and wear-resistant surface.

Where a polymeric binder material is employed in the charge-transport layer, the optimum ratio of charge-transport material to binder material may vary widely depending on the particular polymeric binder(s) employed. In general, it has been found that, when a binder material is employed, useful results are obtained when the amount of polymeric photoconductive charge-transport material contained within the charge-transport layer varies within the range of from about 5 to about 90 weight percent based on the dry weight of the charge-transport layer.

A partial listing of representative materials which may be employed as binders in the charge-transport layer are film-forming, polymeric materials having a fairly high dielectric strength and good electrically insulating properties. Such binders include styrene-butadiene copolymers; polyvinyl toluenestyrene copolymers; styrene-alkyd resins; silicone-alkyd resins; soya-alkyd resins; vinylidene chloride-vinyl chloride copolymers; poly(vinylidene chloride); vinylidene chloride-acrylonitrile copolymers; vinyl acetate-vinyl chloride copolymers; poly(vinyl acetals), such as poly(-vinyl butyral); nitrated polystyrene; polymethylstyrene; isobutylene polymers; polyesters, such as poly[ethylene-co-alkylenebis(alkyleneoxyaryl) phenylenedicarboxylate]; phenolformaldehyde resins; ketone resins; polyamides; polycarbonates, polythiocarbonates; poly-[ethylene-co-isopropylidene-2,2-bis(ethyleneoxyphenylene)terephthalate]; copolymers of vinyl haloarylates and vinyl acetate such as poly(vinyl-m-bromobenzoate-co-vinyl acetate); chlorinated polyolefins such as chlorinated polyethylene; etc. Methods of making resins of this type have been described in the prior art, for example, styrene-alkyd resins can be prepared according to the method described in Gerhart U.S. Pat. No. 2,361,019, issued Oct. 24, 1944 and Rust U.S. Pat. No. 2,258,423, issued Oct. 7, 1941. Suitable resins of the type contemplated for use in the charge-transport layers used in the invention are sold under such tradenames as VITEL PE-101, CYMAC, Piccopale 100, Saran F-220, and LEXAN 145. Other types of binders which can be used in charge transport layers include such materials as paraffin, mineral waxes, etc, as well as combinations of binder materials.

In general, it has been found that polymers containing aromatic or heterocyclic groups are most effective as the binder materials for use in the charge-transport layers because these polymers, by virtue of their heterocyclic or aromatic groups, do not interfere with the transport of charge carriers through the layer. Hetercyclic- or aromatic-containing polymers which are especially useful in p-type, charge-transport layers include styrene-containing polymers, bisphenol-A polycarbonate polymers, phenol-formaldehyde resins, polyesters such as poly[ethylene-co-isopropylidene-2,2-bis(ethyleneoxyphenylene)] terephthalate, and copolymers of vinyl haloarylates and vinylacetate such as poly(vinyl-m-bromobenzoate-co-vinyl acetate).

The thickness of the charge-transport layer may vary. It is especially advantageous to use a charge-transport layer which is thicker than that of the charge-generation layer with good results generally being obtained when the charge-transport layer is about 5 to about 200, and particularly 10 to 40, times as thick as the charge-generation layer. A useful thickness for the charge-generation layer is within the range of from abpout 0.1 to about 15 microns dry thickness, particularly from about 0.5 to about 2 microns. However, useful results can also be obtained using a charge-transport layer which is thinner than the charge-generation layer.

The charge-transport layers described herein are typically applied to the desired substrate by coating a liquid dispersion or solution containing the charge-transport layer components. Typically, the liquid coating vehicle used is an organic vehicle. Typical organic coating vehicles include (1) Aromatic hydrocarbons such as benzene, naphthalene, etc., including substituted aromatic hydrocarbons such as toluene, xylene, mesitylene, etc.;

(2) Ketones such as acetone, 2-butanone, etc.;

(3) Halogenated aliphatic hydrocarbons such as methylene chloride, chloroform, ethylene chloride, etc.;

(4) Ethers including cyclic ethers such as tetrahydrofuran, ethyl ether;

(5) Mixtures of the above.

The charge-transport layer may also contain other addenda such as leveling agents, surfactants, plasticizers, and the like to enhance or improve various physical properties of the charge-transport layer. In addition, various addenda to modify the electrophotographic response of the element may be incorporated in the charge-transport layer. For example, various contrast control materials, such as certain hole-trapping agents and certain easily oxidized dyes may be incorporated in the charge-transport layer. Various such contrast control materials are described in *Research Disclosure*, Vol. 122, June 1974, page 33, in an article entitled "Additives for Contrast Control in Organic Photoconductor Composition and Elements".

Further details regarding the multi-phase aggregate composition used as the charge-generation layer in a multi-active, photoconductive insulating element of the type described above may be obtained from the description presented hereinafter regarding multiphase, aggregate, photoconductive insulating compositions. It will be appreciated that the charge-generation layer of the multi-active photoconductive element described above consists essentially of the same composition as is used in a conventional, single-layer, multiphase, aggregate photoconductive composition of the type described in Light, U.S. Pat. No. 3,615,414. However, for optimum results, it is generally preferable to use a thinner multi-phase aggregate composition for use as a charge-generation layer in a multi-active photoconductive element than is used in a comparable conventional, single-layer, multiphase, aggregate photoconductive composition.

As indicated above, in accord with other embodiments of the invention, the photoconductive polymer of the invention may also advantageously be employed in conventional, single-layer, multi-phase, aggregate photoconductive insulating compositions of the type described in Light, U.S. Pat. No. 3,615,414, which contains a separate, photoconductive material in the continuous, polymer phase of the aggregate composition. In accord with this embodiment, the aggregate photoconductive composition comprises, in the continuous polymer phase thereof, one or more photoconductive polymers of the present invention.

The aggregate compositions used in this invention comprise an organic sensitizing dye and an electrically insulating, film-forming polymeric material. They may be prepared by several techniques, such as, for example, the so-called "dye first" technique described in Gramza et al. U.S. Pat. No. 3,615,396 issued Oct. 26, 1971. Alternatively, they may be prepared by the so-called "shearing" method described in Gramza, U.S. Pat. No. 3,615,415 issued Oct. 26, 1971. This latter method involves the high speed shearing of the composition prior to coating and thus eliminates subsequent solvent treatment, as was disclosed in Light, U.S. Pat. No. 3,615,414 referred to above. By whatever method prepared, the aggregate composition, optionally combined with the photoconductive polymers of the invention, in a suitable solvent is coated on a suitable support to form a separately identifiable multiphase composition, the heterogeneous nature of which is generally apparent when viewed under magnification, although such compositions may appear to be substantially optically clear to the naked eye in the absence of magnification. There can, of course, be macroscopic heterogeneity. Suitably, the dye-containing aggregate in the discontinuous phase is finely-divided, i.e., typically predominantly in the size range of from about 0.01 to about 25 microns.

In general, the aggregate compositions formed as described herein are multiphase organic solids containing dye and polymer. The polymer forms an amorphous matrix or continuous phase which contains a discrete, discontinuous phase as distinguished from a solution. The discontinuous phase is the aggregate species which is a co-crystalline complex comprised of dye and polymer.

The term co-crystalline complex as used herein has reference to a crystalline compound which contains dye and polymer molecules co-crystallized in a single crystalline structure to form a regular array of the molecules in a three-dimensional pattern.

Another feature characteristic of the aggregate compositions formed as described herein is that the wavelength of the radiation absorption maximum characteristic of such compositions is substantially shifted from the wavelength of the radiation absorption maximum of a substantially homogeneous dye-polymer solid solution formed of similar constituents. The new absorption maximum characteristic of the aggregates formed by this method is not necessarily an overall maximum for this system as this will depend upon the relative amount of dye in the aggregate. Such an absorption maximum shift in the formation of aggregate systems for the present invention is generally of the magnitude of at least about 10 nm. If mixtures of dyes are used, one dye may cause an absorption maximum shift to a long wavelength and another dye cause an absorption maximum shift to a shorter wavelength. In such cases, a formation of the aggregate compositions can more easily be identified by viewing under magnification.

Sensitizing dyes and electrically insulating polymeric materials are used in forming these aggregate compositions. Typically, pyrylium-type dye salts, including pyrylium, bispyrylium, thiapyrylium and selenapyrylium dye salts and also including salts of pyrylium compounds containing condensed ring systems such as salts of benzopyrylium and naphthopyrylium dyes, are useful in forming such compositions. Dyes from these classes which may be useful are disclosed in Light, U.S. Pat. No. 3,615,414.

Particularly useful dyes in forming the feature aggregates are pyrylium dye salts having the formula:

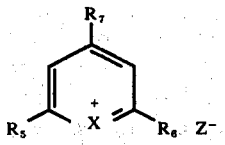

wherein $R_5$ and $R_6$ can each be phenyl group, including substituted phenyl group having at least one substituent chosen from alkyl groups of from 1 to about 6 carbon atoms and alkoxy group having from 1 to about 6 carbon atoms;

$R_7$ can be an alkylamino-substituted phenyl group having from 1 to 6 carbon atoms in the alkyl group, and including dialkylamino-substituted and haloalkylamino-substituted phenyl groups;

X can be an oxygen, selenium, or a sulfur atom; and $Z^-$ is an anion.

The polymers useful in forming the aggregate compositions include a variety of materials. Particularly useful are electrically insulating, film-forming polymers having an alkylidene diarylene group in a recurring unit such as those linear polymers, including copolymers, containing the following group in a recurring unit:

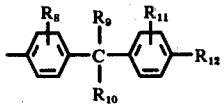

wherein:

$R_9$ and $R_{10}$, when taken separately, can each be a hydrogen atom, an alkyl group having from one to about 10 carbon atoms such as methyl, ethyl, isobutyl, hexyl, heptyl, octyl, nonyl, decyl, and the like, including substituted alkyl groups such as trifluoromethyl, etc., and an aryl group such as phenyl and naphthyl, including substituted aryl groups having such substitutents as a halogen atom, an alkyl group of from 1 to about 5 carbon atoms, etc.; and $R_9$ and $R_{10}$, when taken together, can represent the carbon atoms necessary to complete a saturated cyclic hydrocarbon group including cycloalkanes such as cyclohexyl and polycycloalkanes such as norbornyl, the total number of carbon atoms in $R_9$ and $R_{10}$ being up to about 19;

$R_8$ and $R_{11}$ can each be hydrogen, an alkyl group of from 1 to about 5 carbon atoms, e.g., or a halogen such as chloro, bromo, iodo, etc.; and $R_{12}$ is a divalent group selected from the following:

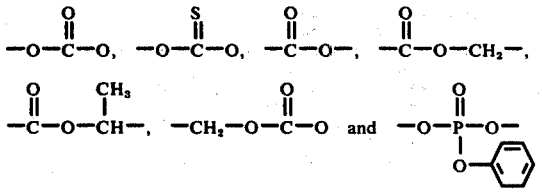

Preferred polymers useful for forming aggregate crystals are hydrophobic carbonate polymers containing the following group in a recurring unit:

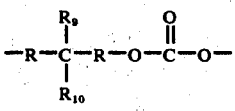

wherein:

each R is a phenylene group including halo substituted phenylene groups and alkyl-substituted phenylene groups; and $R_9$ and $R_{10}$ are as described above. Such compositions are disclosed, for example, in U.S. Pat. Nos. 3,028,365 and 3,317,466. Preferably polycarbonates containing an alkylidene diarylene group in the recurring unit such as those prepared with Bisphenol A and including polymeric products of ester exchange between diphenylcarbonate and 2,2-bis-(4-hydroxyphenyl)-propane are useful in the practice of this invention. Such compositions are disclosed in the following U.S. Patents: U.S. Pat. Nos. 2,999,750 by Miller et al., issued Sept. 12, 1961; 3,038,879 by Laakso et al., issued June 12, 1962; 3,038,880 by Laakso et al., issued June 12, 1962; 3,106,544 by Laakso et al., issued Oct. 8, 1963; 3,106,545 by Laakso et al., issued Oct. 8, 1963; and 3,106,546 by Laakso et al., issued Oct. 8, 1963. A wide range of film-forming polycarbonate resins are useful, with completely satisfactory results being obtained when using commercial polymeric materials which are characterized by an inherent viscosity of about 0.5 to about 1.8.

The following polymers are included among the materials useful in the practice of this invention:

Table 2

| No. | Polymeric Material |
|---|---|
| 1 | poly(4,4'-isopropylidenediphenylene-co-1,4-cyclohexylenedimethylene carbonate) |
| 2 | poly(ethylenedioxy-3,3'-phenylene thiocarbonate) |
| 3 | poly(4,4'-isopropylidenediphenylene carbonate-co-terephthalate) |
| 4 | poly(4,4'-isopropylidenediphenylene carbonate) |
| 5 | poly(4,4'-isopropylidenediphenylene thiocarbonate) |
| 6 | poly(4,4'-sec-butylidenediphenylene carbonate) |
| 7 | poly(4,4'-isopropylidenediphenylene carbonate-block-oxyethylene) |
| 8 | poly(4,4'-isopropylidenediphenylene carbonate-block-oxytetramethylene) |
| 9 | poly[4,4'-isopropylidenebis(2-methylphenylene)-carbonate] |
| 10 | poly(4,4'-isopropylidenediphenylene-co-1,4-phenylene carbonate) |
| 11 | poly(4,4'-isopropylidenediphenylene-co-1,3-phenylene carbonate) |
| 12 | poly(4,4'-isopropylidenediphenylene-co-4,4'-diphenylene carbonate) |
| 13 | poly(4,4'-isopropylidenediphenylene-co-4,4'-oxydiphenylene carbonate) |
| 14 | poly(4,4'-isopropylidenediphenylene-co-4,4'-carbonyldiphenylene carbonate) |
| 15 | poly(4,4'-isopropylidenediphenylene-co-4,4'-ethylenediphenylene carbonate) |
| 16 | poly[4,4'-methylenebis(2-methylphenylene)carbonate] |
| 17 | poly[1,1-(p-bromophenylethylidene)bis(1,4-phenylene)carbonate] |
| 18 | poly[4,4'-isopropylidenediphenylene-co-4,4'-sulfonyldiphenylene)carbonate] |
| 19 | poly[4,4'-cyclohexylidene(4-diphenylene) carbonate] |
| 20 | poly[4,4'-isopropylidenebis(2-chlorophenylene)carbonate] |
| 21 | poly(4,4'-hexafluoroisopropylidenediphenylene carbonate) |
| 22 | poly(4,4'-isopropylidenediphenylene 4,4'-isopropylidenebenzoate) |
| 23 | poly(4,4'-isopropylidenedibenzyl 4,4'-isopropylidenedibenzoate) |
| 24 | poly[ 4,4'-(1,2-dimethylpropylidene)diphenylene carbonate] |
| 25 | poly[4,4'-(1,2,2-trimethylpropylidene)-diphenylene carbonate] |
| 26 | poly{4,4'-[1-(α-naphthyl)ethylidene]-diphenylene carbonate} |
| 27 | poly[4,4'-(1,3-dimethylbutylidene)-diphenylene carbonate] |
| 28 | poly[4,4'-(2-norbornylidene)diphenylene carbonate] |
| 29 | poly[4,4'-(hexahydro-4,7-methanoindan-5-ylidene) diphenylene carbonate] |

The amount of the above-described, pyrylium-type dye salt used in the various aggregate-containing compositions described herein may vary. Useful results are obtained by employing the described pyrylium-type dye salts in amounts of from about 0.001 to about 50 percent based on the dry weight of the aggregate composition. When the aggregate composition also has incorporated therein one or more additional photoconductive materials, useful results are obtained by using the described pyrylium-type dye salts in amounts of from about 0.001 to about 30 percent by weight based on the dry weight of the aggregate composition, although the amount used can vary widely depending upon such factors as individual dye salt solubility, the polymer contained in the continuous phase, additional photoconductive materials, the electrophotographic response desired, the mechanical properties desired, etc. Similarly, the amount of dialkylidene diarylene group-containing polymer used in the aggregate composition referred to herein may vary. Typically, these aggregate compositions contain an amount of this polymer within the range of from about 20 to about 98 weight percent based on the dry weight of the aggregate composition, although larger or smaller amounts may also be used.

Electrophotographic elements of the invention containing the above-described aggregate composition can be prepared by blending a dispersion or solution of the composition and coating or forming a self-supporting layer with the materials. Supplemental materials useful for changing the spectral sensitivity or electrophotosensitivity of the element can be added to the composition of the element when it is desirable to produce the characteristic effect of such materials. If desired, other polymers can be incorporated in the vehicle, for example, to alter physical properties such as adhesion of the aggregate-containing layer to the support and the like. Techniques for the preparation of aggregate layers containing such additional vehicles are described in C. L. Stephens, U.S. Pat. No. 3,679,407 issued July 25, 1972, and in Gramza et al., U.S. Pat. No. 3,732,180. The aggregate photoconductive layers of the invention can also be sensitized by the addition of effective amounts of sensitizing compounds to exhibit improved electrophotosensitivity. Of course, the multi-phase, aggregate compositions may also contain other addenda such as leveling agents, surfactants, plasticizers, contrast control material and the like to enhance or improve various physical properties or electrophotographic response characteristics of the aggregate photoconductive layer.

In accord with that embodiment of the invention wherein the polymeric photoconductive materials of the invention are used as a separate photoconductive material incorporated in a single layer, aggregate photoconductive composition, the amounts thereof which can be used may be varied over a relatively wide range. When used in a single layer aggregate photoconductive composition, the photoconductive polymers described herein or a mixture thereof are contained in the continuous phase of the aggregate composition and may be present in an amount within the range of from about 1.0 to about 60.0 percent by weight (based on the dry weight of the aggregate photoconductive composition). Larger or smaller amounts of the photoconductive polymer compound may also be employed in single-layer, aggregate photoconductive compositions although best results are generally obtained when using an amount within the aforementioned range.

In addition to electrographic elements containing the above-described, aggregate photoconductive compositions, there are other useful embodiments of the present invention. For example, "non-aggregate-containing" electrographic elements can be prepared with the polymeric photoconductive compounds of the invention in the usual manner, i.e., by blending a dispersion or solution of the polymeric photoconductive compound together with a binder, when necessary or desirable, and coating or forming a self-supporting layer with the photoconductor-containing materials. Likewise, other organic, including metalloorganic, and inorganic photoconductors known in the art can be combined with the present polymeric photoconductors. In addition, supplemental materials useful for changing the spectral sensitivity or electrophotosensitivity of the element can be added to the composition of the element when it is desirable to produce the characteristic effect of such materials.

The non-aggregate photoconductive insulating layers of the invention, such as homogeneous organic photoconductive compositions, can be sensitized by the addition of amounts of sensitizing compounds effective to provide improved electrophotosensitivity. Sensitizing compounds useful with the polymeric photoconductive materials of the present invention can be selected from a wide variety of materials, including such materials as pyrylium dye salts including thiapyrylium dye salts and selenapyrylium dye salts disclosed in VanAllan et al U.S. Pat. No. 3,250,615; fluorenes, such as 7,12-dioxo-13-dibenzo(a,h)fluorene, 5,10-dioxo-4a,11-diazobenzo(b)-fluorene, 3,13-dioxo-7-oxadibenzo (b,g)fluorene, and the like; aromatic nitro compounds of the kinds described in U.S. Pat. No. 2,610,120; anthrones like those disclosed in U.S. Pat. No. 2,670,284; quinones, U.S. Pat. No. 2,670,286; benzophenones, U.S. Pat. No. 2,670,287; thiazoles, U.S. Pat. No. 3,732,301; mineral acids; carboxylic acids, such as maleic acid, dichloroacetic acid, trichloroacetic acid and salicyclic acid, sulfonic and phosphoric acids, and various dyes, such as cyanine (including carbocyanine), merocyanine, diarylmethane, thiazine, azine, oxazine, xanthene, phthalein, acridine, azo, anthraquinone dyes and the like and mixtures thereof. The sensitizers preferred for use with the polymers of this invention are selected from pyrylimum salts including selanapyrylium salts and thiapyrylium salts, and cyanine dyes including carbocyanine dyes.

Where a sensitizing compound is employed with the binder and polymeric photoconductor to form a sensitized, nonaggregate containing photoconductive composition, it is the normal practice to mix a suitable amount of the sensitizing compound with the coating composition so that, after thorough mixing, the sensitizing compound is uniformly distributed in the coated layer.

Other methods of incorporating the sensitizer or the effect of the sensitizer may, however, be employed consistent with the practice of this invention. In preparing the nonaggregate photoconductive layers, no sensitizing compound is required in these layers to obtain photoconductivity with respect to ultraviolet radiation sources; therefore, a sensitizer is not required in the non-aggregate photoconductive layers of the invention. However, since relatively minor amounts of sensitizer are effective in (a) producing a layer exhibiting photoconductivity with respect to visible light and/or (b) substantially increasing the electrical speed of the layer the use of a sensitizer is generally preferred. The amount of sensitizer that can be added to a non-aggreate photoconductive layer to give effective increases in speed can vary widely. The optimum concentration in any given case will vary with the specific polymeric photoconductor and sensitizing compound used. In general, substantial speed gains can be obtained where an appropriate sensitizer is added in a concentration range from about 0.001 to about 30 percent by weight based on the dry weight of the non-aggregate photoconductive composition, preferably an amount of from about 0.005 to about 10 percent by weight of the composition.

When a binder is incorporated in the non-aggregate photoconductve layers of the invention, preferred binders are film-forming, hydrophobic polymeric binders having fairly high dielectric strength and good electrical insulating properties.

Typical of these materials are:

I. Natural resins including gelatin, cellulose ester derivatives such as alkyl esters of carboxylated cellulose, hydroxy ethyl cellulose, carboxy methyl cellulose, carboxy methyl hydroxy ethyl cellulose, etc.;

II. Vinyl resins including a. polyvinyl esters such as a vinyl acetate resin, a copolymer of vinyl acetate and crotonic acid, a copolymer of vinyl acetate with an ester of vinyl alcohol and a higher aliphatic carboxylic acid such as lauric acid or steraric acid, polyvinyl stearate, a copolymer of vinyl acetate and maleic acid, a poly(vinylhaloarylate) such as poly(vinyl-m-bromobenzoate-covinyl acetate), a terpolymer of vinyl butyral with vinyl alcohol and vinyl acetate, etc.;

b. vinyl chloride and vinylidene chloride polymers such as a poly(vinylchloride), a copolymer of vinyl chloride and vinyl isobutyl ether, a copolymer of vinylidene chloride and acrylonitrile, a terpolymer of vinyl chloride, vinyl acetate and vinyl alcohol, poly(vinylidene chloride) a terpolymer of vinyl chloride, vinyl acetate and maleic anhydride, a copolymer of vinyl chloride and vinyl acetate, etc.;

c. styrene polymers such as polystyrene, a nitrated polystyrene, a copolymer of styrene and monoisobutyl maleate, a copolymer of styrene with methacrylic acid, a copolymer of styrene and butadiene, a copolymer of dimethylitaconate and styrene, polymethylstyrene, etc.;

d. methacrylic acid ester polymers such as a poly(alkylmethacrylate), etc.;

e. polyolefins such as chlorinated polyethylene, chlorinated polypropylene, poly(isobutylene),etc.;

f. poly(vinyl acetals) such as poly(vinyl butyral), etc.; and g. poly(vinyl alcohol);

III. Polycondensates including a. a polyester of 1,3-disulfonbenzene and 2,2-bis(4-hydroxyphenyl)propane;

b. a polyester of diphenyl-p,p'-disulphonic acid and 2,2-bis(4-hydroxyphenyl)propane;

c. a polyester of 4,4'-dicarboxyphenyl ether and 2,2-bis(4-hydroxyphenyl)propane;

d. a polyester of 2,2-bis(4-hydroxyphenyl)propane and fumaric acid;

e. polyester of pentaerythritol and phthalic acid;

f. resinous terpene polybasic acid;

g. a polyester of phosphoric acid and hydroquinone;

h. polyphosphites;

i. polyester of neopentyl glycol and isophthalic acid;

j. polycarbonates including polythiocarbonates such as the polycarbonate of 2,2-bis(4-hydroxyphenyl)propane;

k. polyester of isophthalic acid, 2,2-bis[4-(β-hydroxyethoxy)phenyl]propane and ethylene glycol;
l. polyester of terephthalic acid, 2,2-bis[4-(β-hydroxyethoxy)phenyl]propane and ethylene glycol;
m. polyester of ethylene glycol, neopentyl glycol, terephthalic acid and isophthalic acid;
n. polyamides;
o. ketone resins; and
p. phenol-formaldehyde resins;

IV. Silicone resins;

V. Alkyl resins including styrene-alkyl resins, silicone-alkyl resins, soya-alkyd resins, etc.;

VI. Polyamides;

VII. Paraffin; and

VIII. Mineral waxes.

Solvents useful for preparing non-aggregate photoconductive coating compositions containing the polymeric photoconductors of the present invention can include wide variety of organic solvents for the components of the coating composition.

Typical solvents include:

(1) Aromatic hydrocarbons such as benzene, naphthalene, etc., including substituted aromatic hydrocarbons such as toluene, xylene, mesitylene, etc.;

(2) Ketones such as acetone, 2-butanone, etc.;

(3) Halogenated aliphatic hydrocarbons such as methylene chloride, chloroform, ethylene chloride, etc.;

(4) Ethers including cyclic ethers such as tetrahydrofuran, ethylether;

(5) Mixtures of the above.

In preparing the non-aggregate-containing organic photoconductive coating compositions of the present invention, useful results are obtained where the photoconductor is present in an amount equal to at least about 1.0 weight percent based on the dry weight of the composition. If the polymeric photoconductor of the invention is the only photoconductor in a specific non-aggregate photoconductive composition under consideration, it is typical to employ at least about 15 percent by weight of the polymeric photoconductor of the invention in the composition. The upper limit in the amount of polymeric photoconductive material present in a particular non-aggregate photoconductive composition can be widely varied. Because the photoconductors of the invention are polymeric, although usually of farily low molecular weight, they do possess sufficient film-forming properties so that it is possible to prepare a non-aggregate photoconductive composition containing only the polymeric photoconductor of the invention without using any separate film-forming, polymeric, binder component. More typically, to provide improved film-forming properties, to obtain better adhesion to an underlying support (if one is used), and to provide enhanced wear resistance; one or more additional polymeric binder components of the type described above are employed in the non-aggregate photoconductive composition of the invention. Typically, the binder, when used, is present in an amount within the range of from about 85 to about 10 percent by weight based on the dry weight of the non-aggregate photoconductive composition.

Optional overcoat layers may be used in the present invention, if desired. For example, to improve surface hardness and resistance to abrasion, the surface layer of the various photoconductive elements of the invention may be coated with one or more electrically insulating, organic polymer coatings or electrically insulating, inorganic coatings. A number of such coatings are well known in the art and accordingly extended discussion thereof is unnecessary. Typical useful such overcoats are described, for example, in *Research Disclosure*, "Electrophotographic Elements, Materials, and Proceses", Volume 109, page 63, Paragraph V, May, 1973, which is incorporated by reference herein.

In addition, when the various photoconductive compositions of the invention are temporarily or permanently affixed to an electrically conducting support one or more interlayers such as an adhesive subbing layer and/or electrical barrier layer may be interposed between the photoconductive composition and the conducting support to improved adhesion to the support and/or the electrical performance of the element. These interlayers may be composed of an organic polymeric material such as a vinylidene chloride-containing copolymer or an inorganic material. A number of such interlayers are known in the art and accordingly extended discussion thereof is unnecessary. Typical useful interlayers are described, for example, in *Research Disclosure*, "Electrophotographic Elements, Materials, and Processes,"Volume 109, page 62, Paragraph II, May 1973, which is incorporated by reference herein.

Suitable supporting materials on which the photoconductive compositions of this invention can be coated include any of a wide variety of electrically conducting supports, for example, paper (at a relative humidity above 20 percent); aluminum-paper laminates; metal foils such as aluminum foil, zinc foil, etc.; metal plates, such as aluminum, copper, zinc, brass and galvanized plates; vapor deposited metal layers such as silver, nickel, aluminum and the like coated on paper or conventional photographic film bases such as cellulose acetate, polystyrene, etc. Such conducting materials as nickel can be vacuum deposited on transparent film supports in sufficiently thin layers to allow electrophotographic elements prepared therewith to be exposed from either side of such elements. An especially useful conducting support can be prepared by coating a support material, such as poly(ethylene terephthalate), with a conducting layer containing a semiconductor dispersed in a resin. Such conducting layers both with and without electrical barrier layers are described in U.S. Pat. No. 3,245,833 by Trevoy issued Apr. 12, 1966 and Dessauer, U.S. Pat. No. 2,901,348, issued Aug. 25, 1969. Other useful conducting layers include compositions consisting essentially of an intimate mixture of at least one protective inorganic oxide and from about 30 to about 70 percent by weight of at least one conducting metal, e.g., a vacuum-deposited cermet conducting layer as described in Rasch, U.S. Pat. No. 486,284, filed July 8, 1974. Likewise, a suitable conducting coating can be prepared from the sodium salt of a carboxyester lactone of maleic anhydride and a vinyl acetate polymer. Such kinds of conducting layers are methods for their optimum preparation and use are disclosed in U.S. Pat. No. 3,007,901 by Minsk, issued Nov. 7, 1961 and 3,262,807 by Sterman et al issued July 26, 1966. Likewise, a suitable conducting coating can be prepared from the sodium salt of a carboxyester lactone of maleic anhydride and a vinly acetate polymer. Such kinds of conducting layers and methods for their optimum preparation and use are disclosed in U.S. Pat. No. 3,007,901 by Minsk, issued Nov. 7, 1961 and 3,262,807 by Sterman et al, issued July 26, 1966.

Coating thicknesses of the single layer aggregate and non-aggregate photoconducting compositions of the invention, when coated on a suitable support, can vary widely. Normally, a coating in the range of about 10 microns to about 300 microns before drying is useful for the practice of this invention. The preferred range of coating thickness is found to be in the range from about 50 microns to about 150 microns before drying, although useful results can be obtained outside of this range. The resultant dry thickness of the coating is preferably between about 2 microns and about 50 microns, although useful results can be obtained with a dry coating thickness between about 1 and abut 200 microns.

After the photoconductive insulating elements prepared according to this invention have been dried, they can be employed in any of the well-known electrophotographic processes which require photoconductive materials. One such process is the xerographic process. In a process of this type, an electrophotographic element is held in the dark and given a blanket electrostatic charge by placing it under a corona discharge. This uniform charge is retained by the element because of the substantial dark insulating property of the layer, i.e., the low conductivity of the layer in the dark. The electrostatic charge formed on the surface of the photoconductive element is then selectively dissipated from the surface of the element by imagewise exposure to light by means of a conventional exposure operation such as, for example, by a contact printing technique, or by lens projection of an image, and the like, to thereby form a latent, electrostatic image in the photoconductive element. Exposing the surface in this manner forms a pattern of electrostatic charge by virtue of the fact that light energy striking the photoconductor causes the electrostatic charge in the light struck areas to be conducted away from the surface in proportion to the intensity of the illumination in a particular area.

The charge pattern produced by exposure is then developed or transferred to another surface and developed there, i.e., either the charged or uncharged areas rendered visible, by treatment with a medium comprising electrostatically responsive particles having optical density. The electrostatically-responsive, developing particles can be in the form of a dust, i.e., powder, or a pigment in a resinous carrier, i.e., toner. A preferred method of applying such toner to a latent electrostatic image for solid area development is by the use of a magnetic brush. Methods of forming and using a magnetic brush toner applicator are described in the following U.S. Pat. Nos.; 2,786,439 by Young, issued Mar. 26, 1957; 2,786,440 by Giaimo, issued Mar. 26, 1957; 2,786,441 by Young, issued Mar, 26, 1957; 2,874,063 by Greig, issued Feb. 17, 1959. Liquid development of the latent electrostatic image may also be used. In liquid development, the developing particles are carried to the image-bearing surface in an electrically insulating liquid carrier. Methods of development of this type are widely known and have been described in the patent literature, for example, U.S. Pat. No. 2,907,674 by Metcalfe et al, issued Oct. 6, 1959. In dry developing processes, the most widely used method of obtaining a permanent record is achieved by selecting a developing particle which has as one of its components a low-melting resin. Heating the powder image then causes the resin to melt or fuse into or on the element. The powder is, therefore, caused to adhere permanently to the surface of the photoconductive element. In other cases, a transfer of the electrostatic charge image formed on the photoconductive element can be made to a second support such as paper which would then become the final print after development and fusing. Techniques of the type indicated are well known in the art and have been described in the literature such as in "RCA Review" Vol. 15 (1954) pages 469–484.

The electrical resistivity of the various photoconductive insulating elements of the invention (as measured across the photoconductive insulating layer of these elements in the absence of activating radiation for this layer, or, in the case of the aforementioned multi-active elements, as measured across the charge-transport layer and the charge-generation layer in the absence of activating radiation and any other radiation to which the charge transport layer may be sensitive) should be at least about $10^9$ ohm-cms at 25° C. In general, it is advantageous to use photoconductive insulating elements having a resistivity several orders of magnitude higher than $10^{10}$ ohms-cms, for example, elements having an electrical resistivity greater than about $10^{14}$ ohm-cms at 25° C.

The following examples are included for a further understanding of the invention.

EXAMPLE 1

The preparation of the polymer from the condensation of N-methyl-diphenylamine and isobutyraldehyde, formula III of Table 1, was accomplished according to the following reaction equation:

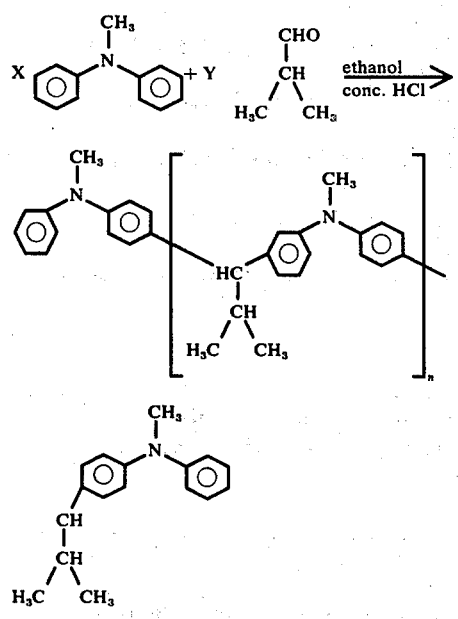

wherein $n$ is as defined earlier herein, $x = n+2$, and $y = n+1$

Specifically, a mixture of N-methyldiphenylamine, 100 g, concentrated hydrochloric acid, 30 mls, ethanol 134 mls, and isobutyraldehyde, 28.8 g, was stirred in a sealed pressure bottle by a magnetic stirrer bar, with heating in a steam bath overnight. The mixture consisted of two phases. The next morning the mixture was cooled, when the lower phase hardened to an off-white solid. The upper phase, a blue-green liquid, was decanted. Fresh ethanol, 200 mls, was added to the bottle which was resealed, and reheated on the steam bath with intermittent shaking. The bottle was then cooled and the ethanol was discarded. This washing operation was repeated twice more. The residual solid was found to be green in the center of the mass. Forty grams of the solid were taken into solution in benzene and passed through a column of 454 g. neutral alumina made up in cyclohexane. The column was eluted with benzene: the effluent was colorless. The latter was examined by thin layer chromatography using Eastman silica Chromagram sheet with 30% benzene in cyclohexane as eluent, and product was found to be concentrated mainly in the first liter, although the second and third liters also contained small quantities of lower $R_f$ components. The three fractions were combined and evaporated down at reduced pressure. The residue was heated on the steam bath with alcohol, 50 mls, and the mixture was then cooled and the ethanol was decanted. The organic residue was gradually broken up with a spatula into small fragments, which were dried overnight at room temperature, in vacuo, and then became a very easily powdered solid. The product had a number average, polystyrene equivalent, molecular weight of 892 and a weight average, polystyrene equivalent, molecular weight of 1414, as determined by gel permeation chromatography.

EXAMPLES 2 THROUGH 7

In a manner similar to Example 1 above were prepared polymeric products by the condensation of:

- N-Methyldiphenylamine and acetaldehyde, (formula IV of Table 1).
- N-Methyldiphenylamine and isovaleraldehyde, formula V of Table 1.
- N-Methyldiphenylamine and 2-butanone, formula VI of Table 1.
- N-Methyldiphenylamine and cyclopentanone, formula VII of Table 1.
- N-Ethyldiphenylamine and isobutyraldehyde, formula VIII of Table 1.
- N-Ethylcarbazole and isobutyraldehyde, formula IX of Table 1.

EXAMPLE 8

The polymeric materials described in Examples 1–7 above were utilized individually as the photoconductor in one or more of the following electrophotographic compositions:

| Homogeneous Non-Aggregate Photoconductive Coating Composition |
|---|
| Biphenol A Polycarbonate binder (Lexan$^R$ 145) 0.63 g (purchased from General Electric Co.)<br>Polymeric Photoconductor 0.63 g<br>2,6-Bis(4-ethylphenyl)-4-(4-n-amyloxyphenyl) thiapyrylium perchlorate 0.01 g<br>Dichloromethane 7.2 ml |

| Aggregate Photoconductive Coating Composition |
|---|
| Bisphenol A Polycarbonate (Lexan$^R$ 145) 1.0 g<br>Polymeric Photoconductor 0.25 g<br>4-p-Dimethylaminophenyl-2,6-diphenylthiapyrylium perchlorate 0.25 g<br>Dichloromethane 9.6 g |

The above-noted aggregate coating composition was coated to form an aggregate photoconductive composition as described in Example 8 of U.S. Pat. No. 3,615,396. The above-noted compositions were coated on a poly(ethylene terephthalate) base overcoated with an evaporated nickel conductive layer and tested to yield the data shown in Table 3.

The relative speed measurements reported in this and the following examples are relative H and D electrical speeds. The relative H and D electrical speeds measure the speed of a given photoconductive material relative to other materials typically within the same test group of materials. The relative speed values are not absolute speed values. However, relative speed values are related to absolute speed values. The relative electrical speed (shoulder or toe speed) is obtained simply by arbitrarily assigning a value, Ro, to one particulate absolute shoulder or toe speed of one particular photoconductive material. The relative shoulder or toe speed, Rn, of any other photoconductive material, n, relative to this value, Ro, may then be calculated as follows: $Rn = (A_n)(^{Ro}/_{Ao})$ wherein An is the absolute electrical speed of material $n$, Ro is the speed value arbitrarily assigned to the first material, and Ao is the absolute electrical speed of the first material. The absolute H and D electrical speed, either the shoulder (SH) or toe speed, of a material may be determined as follows: The material is electrostatically charged under, for example, a corona source until the surface potential, as measured by an electrometer probe, reaches some suitable initial value $V_o$, typically about 600 volts. The charged element is then exposed to a 3000° K tungsten light source through a stepped density gray scale. The exposure causes reduction of the surface potential of the element under each step of the gray scale from its initial potential $V_o$ to some lower potential V the exact value of which depends upon the amount of exposure in meter-candle-seconds received by the area. The results of these measurements are then plotted on a graph of surface potential V vs. log exposure for each step, thereby forming an electrical characteristic curve. The electrical or electrophotographic speed of the photoconductive composition can then be expressed in terms of the reciprocal of the exposure required to reduce the surface potential to any fixed selected value. The actual positive or negative shoulder speed is the numerical expression of $10^4$ divided by the exposure in meter-candle-seconds required to reduce the initial surface potential $V_o$ to some value equal to $V_o$ minus 100. This is referred to as the 100 volt shoulder speed. Sometimes it is desirable to determine the 50 volt shoulder speed and, in that instance, the exposure used is that required to reduce the surface potential to $V_o$ minus 50. Similarly, the actual positive or negative toe speed is the numerical expression of $10^4$ divided by the exposure in meter-candle-seconds required to reduce the initial potential $V_o$ to an absolute value of 100 volts. Again, if one wishes to determine the 50 volt toe speed, one merely uses the exposure required to reduce $V_o$ to an absolute value of 50 volts. An apparatus useful for determining the electrophotographic speeds of photoconductive compositions is described in Robinson et al, U.S. Pat. No. 3,449,658, issued June 10, 1969.

Table 3

| Polymer of Table 1 | Relative Electrical H & D Speed Homogeneous (+SH/100 Volt Toe) | Homogeneous (−SH/100 Volt Toe) | Aggregate (+SH/100 Volt Toe) | Aggregate (−SH/100 Volt Toe) |
|---|---|---|---|---|
| III | 800/12 | 16/1.0* | 1100/50 | 500/40 |
| IV | 57/3 | 20/1.2 | 570/16 | 700/45 |
| V | 22/1.8 | 23/1.2 | 520/50 | 300/32 |
| VI | 47/4.5 | 40/2.3 | 1000/105 | 520/47 |
| VII | 40/3 | 28/1.8 | 610/9 | 320/30 |
| VIII | 22/2.2 | 19/1.2 | 560/25 | 500/30 |
| IX | 45/2.5 | 50/1.8 | — | — |

*arbitrarily assigned a relative speed of 1.0

EXAMPLE 9

The polymeric compounds described in this application were also used as p-type charge-transport materials in a multi-active photoconductive element of the type described in Berwick et. al., U.S. Ser. No. 534,979, now a continuation-in-part of U.S. Ser. No. 639,039, filed concurrently herewith, and as further set out below: A. An aggregate charge-generation layer of the type described in the above-noted Berwick et. al. patent application was prepared, using a coating formulation having the following composition:

AGGREGATE

CHARGE-GENERATION COATING COMPOSITION

Bisphenol A polycarbonate — 30.96 g.
4-(4-dimethylaminophenyl)-2,6-diphenylthiapyrylium perchlorate— 5.45 g
Methylene chloride — 1940.00g A charge-generation layer was made using the above-noted coating formulation by first dissolving the thiapyrylium salt in methylene chloride and stirring for 12 hours before adding the Bisphenol A polycarbonate. The dope was then filtered through a Honeycomb Fulflow E17R1-4C2 filter and coated from an extrusion hopper at 1.08g/m² on a 0.4 optical density vacuum-deposited nickeled film support which had been subbed with a vinylidene chloride (83 weight %) methyl acrylate 15 weight %) itaconic acid (2 weight %) terpolymer. Complete aggregation of this layer was obtained by application thereto of a toluene overcoat applied at 43.2 ml/m².

CHARGE-TRANSPORT LAYER

B. A series of p-type, charge-transport layers were prepared using the polymeric photoconductors of the invention. Each of these layers was composed of one of the two following compositions: (1) 40 percent by weight (based on the dry weight of the transport layer) of Lexan 145 bisphenol A polycarbonate and 60 percent by weight of photoconductor, or (2) 15 percent by weight of Lexan 145 and 85 percent by weight of photoconductor. Each transport layer prepared in this example was coated from an organic solution using chloroform as the organic solvent onto the charge generation layer carried on the subbed, nickel-coated support as described in part A of this Example. A total of 8 different transport layers were prepared, 6 of these transport layers containing the polymeric photoconductors of the invention, 1 of these layers containing the somewhat similar prior art polymeric photoconductor, polyvinylcarbazole, as a control, and 1 of these layers containing a highly efficient monomeric charge-transport material, tri-p-totylamine, as a control. Each of the resultant multiactive photoconductive elements were subjected to an exposure of visible light having a wavelength of 680 nm. and their relative sensitivity evaluated as indicated in Table 4. Each of the multiactive elements of this example had a charge-generation layer of 1–2$\mu$ dry thickness and a charge-transport layer of 18–19$\mu$ dry thickness. The specific composition of each transport layer evaluated is shown in Table 4.

The relative sensitivity measurements reported in this example are relative electrical sensitivity measurements. The relative electrical sensitivity measures the speed of a given photoconductive element relative to other elements typically within the same test group of elements. The relative sensitivity values are not absolute sensitivity values. However, relative sensitivity values are related to absolute sensitivity values. The relative electrical sensitivity is a dimensionless number and is obtained simply by arbitrarily assigning a value, So, to one particular absolute sensitivity of one particular photoconductive control element. The relative sensitivity Sn, of any other photoconductive element, $n$, relative to this value, So, may then be calculated as follows: $Sn = (B_n)(So/_{Bo})$ wherein $B_n$ is the absolute electrical sensitivity (in ergs/cm²) of $n$, So is the sensitivity value arbitrarily assigned to the control element, and Bo is the absolute electrical sensitivity (measured in ergs/cm²) of the control element.

Table 4

| Organic Photoconductor | Weight % of Organic Photoconductor in Charge-Transport Layer | Relative Sensitivity* |
|---|---|---|
| Tri-p-tolylamine (control) | 40 | 1.0* |
| Compound III | 40 | 1.5 |
| Compound IV | 40 | 1.5 |
| Compound V | 40 | 1.7 |
| Compound VI | 40 | 1.6 |
| Compound VII | 40 | 2.5 |
| Compound III | 85 | 1.1 |
| Poly(vinylcarbazole) (control) | 100 | 100.0 |

*Relative Sensitivity: The relative energy required to discharge the photoreceptor from −500 volts to −100 volts residual potential. The control is arbitrarily assigned a value of 1.0. The listed values are for rear exposures and are corrected for absorption and reflection of the conducting support.

From the relative sensitivity shown in Table 4, it appears that the electrophotographic speed properties of the polymeric photoconductors of the present invention, when used in a p-type charge-transport layer, are quite similar to those observed with the highly-efficient, monomeric photoconductor and charge-transport compound, tri-p-tolylamine. Measurements performed with low-intensity, continuous exposures (which essentially reflect the rate of free carrier generation) and high-intensity, pulsed radiation (which are largely determined by the hole-drift velocity) also give results which are quite comparable for the polymeric photoconductor of the present invention and tri-p-tolylamine. These results thus suggest that the hole-drift mobility and photoinjection efficiency of the low-molecular-weight, polymeric photoconductors of this invention are essentially the same as those noted for tri-p-tolylamine. However, the charge-transport layers containing the polymeric photoconductors of the invention exhibit improved mechanical properties, such as toughness and wear resistance, and improved environmental stability properties, such as improved heat stability, as compared to the monomeric charge-transport material tri-p-tolylamine. In addition, as shown in Table 4, the polymeric photoconductors of the invention, when used as a charge-transport material in a multi-active photoconductive element, exhibit highly improved relative electrical sensitivity as compared to the structurally somewhat similar, prior art, polymeric photoconductor, polyvinylcarbazole.

The invention has been described in detail with particular reference to certain preferred embodiments thereof, but it will be understood that variations and modifications can be effected within the spirit and scope of the invention.

I claim:

1. In a photoconductive insulating element comprising:

a. a conductive support, b. a charge-generation layer coated on said support and c. a charge-transport layer in electrical contact with said charge-generation layer, i. said charge-generation layer having a thickness of about 0.1 to about 15 microns comprising a continuous, electrically insulating, polymer phase and dispersed in said continuous phase a discontinuous phase comprising a finely divided, particulate, co-crystalline complex of (1) at least one polymer having an alkylidene diarylene group in a recurring unit and (2) at least one pyrylium-type dye salt, said co-crystalline complex, upon exposure to activating radiation for said complex, capable of generating and injecting charge carriers into said charge-transport layer, and ii. said charge-transport layer comprising an organic composition in electrical contact with said charge-transport layer, said organic composition comprising as a p-type, charge-transport material an organic photoconductive material capable of accepting and transporting injected charge carriers from said charge-generation layer, the improvement wherein said p-type, charge-transport material is a photoconductive polymer having the formula:

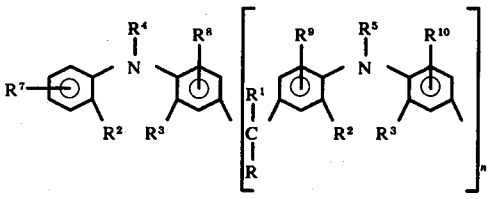

-continued

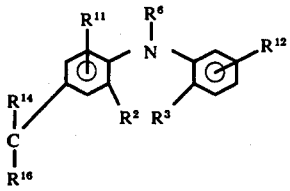

wherein:

$n$ represents an integer of from 0 to about 20;

each of $R^2$ and $R^3$ represents hydrogen or, when taken together, $R^2$ and $R^3$ represent a chemical bond which completes a carbazole nucleus;

Each of $R^4$, $R^5$ and $R^6$, which may be the same or different, represents a member selected from the group consisting of a substituted or unsubstituted alkyl or aryl group, said substituted alkyl group having a substituent selected from the group consisting of an alkoxy, aryloxy, amino, hydroxy, alkylamino, aryl arylamino, nitro, cyano or a halogen group, said substituted aryl group having a substituent selected from the group consisting of an alkoxy, aryloxy, amino, hydroxy, alkylamino, arylamino, nitro, cyano, halogen or alkyl group;

each of $R^7$, $R^8$, $R^9$, $R^{10}$, $R^{11}$ and $R^{12}$, which may be the same or different, represents a member selected from the group consisting of hydrogen, the substituted and unsubstituted alkyl and aryl groups as defined for $R^4$, $R^5$ and $R^6$, an alkoxy group, aryloxy group, halogen, nitro group, cyano group, amino group or an acyl group;

each of $R^1$ and $R^{14}$, which may be the same or different, represents a member selected from the group consisting of hydrogen and the substituted and unsubstituted alkyl and aryl groups defined for $R^4$, $R^5$ and $R^6$; and each of R and $R^{16}$, which may be the same or different, represents a member selected from the substituted and unsubstituted alkyl and aryl groups defined for $R^4$, $R^5$ and $R^6$;

with the proviso that, when taken together, $R^1$ and R or $R^{14}$ and $R^{16}$ represent the carbon atoms necessary to complete a cycloalkyl group containing 3 to about 21 carbon atoms in the cycloalkyl ring.

2. In a photoconductive insulating element having at least two layers comprising a charge-generation layer in electrical contact with a charge-transport layer, a. said charge-generation layer having a thickness of from about 0.1 to about 15 microns comprising a continuous, electrically insulating, polymer phase and dispersed in said continuous phase a discontinuous phase comprising a finely-divided, particulate, co-crystalline complex of (i) at least one polymer having an alkylidene diarylene group in a recurring unit and (ii) at least one pyrylium-type dye salt, said co-crystalline complex, upon exposure to activating radiation for said complex, capable of generating and injecting charge carriers into said charge-transport layer, (b) said charge-transport layer comprising an organic composition containing as a p-type, charge-transport material an organic photoconductive material capable of accepting and transporting injected charge carriers from said charge-generation layer, the improvement wherein said p-type, charge-transport material is a photoconductive polymer having the formula

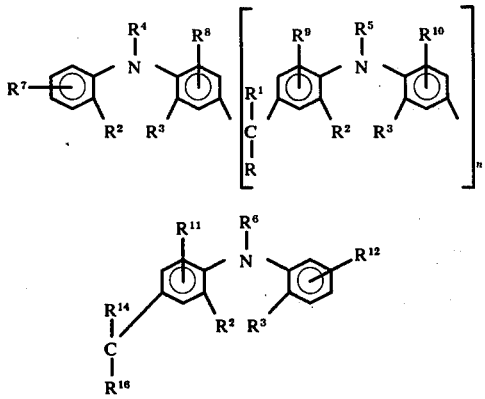

wherein

*n* represents an integer of from 0 to about 20;

$R^2$ and $R^3$ each represent hydrogen or, when taken together, $R^2$ and $R^3$ represent a chemical bond which completes a carbazole nucleus;

$R^4$, $R^5$ and $R^6$, which may be the same or different, each represent a member selected from the group consisting of a substituted or unsubstituted alkyl or aryl group, said substituted alkyl group having a substituent selected from the group consisting of an alkoxy, aryloxy, amino, hydroxy, alkylamino, aryl, arylamino, nitro, cyano, or a halogen group, said substituted aryl group having a substituent selected from the group consisting of an alkoxy, aryloxy, amino, hydroxy, alkylamino, arylamino, nitro, cyano, halogen, or an alkyl group;

$R^7$, $R^8$, $R^9$, $R^{10}$, $R^{11}$ and $R^{12}$, which may be the same or different, each represent a member selected from the group consisting of hydrogen, the substituted and unsubstituted alkyl and aryl groups as defined for $R^4$, $R^5$ and $R^6$, an alkoxy group, aryloxy group, halogen, nitro group, cyano group, amino group, or an acyl group;

$R^1$ and $R^{14}$, which may be the same or different, each represent a member selected from the group consisting of hydrogen and the substituted and unsubstituted alkyl and aryl groups defined for $R^4$, $R^5$ and $R^6$;

R and $R^{16}$, which may be the same or different, each represent a member selected from the substituted and unsubstituted alkyl and aryl groups defined for $R^4$, $R^5$ and $R^6$; with the proviso that, when taken together, $R^1$ and R or $R^{14}$ and $R^{16}$ represent the carbon atoms necessary to complete a cycloalkyl group containing 3 to about 21 carbon atoms in the cycloalkyl ring.

3. A photoconductive insulating element as defined in claim 2 wherein R and $R^{16}$ each represent an unsubstituted alkyl group having 1 to about 8 carbon atoms; $R^4$, $R^5$ and $R^6$ each represent a member selected from the group consisting of an unsubstituted phenyl group, an alkyl-substituted phenyl group having 1 to about 3 carbon atoms in the alkyl substituent, or an unsubstituted alkyl group having 1 to 4 carbon atoms in the alkyl group; $R^1$, $R^2$, $R^3$, $R^7$, $R^8$, $R^9$, $R^{10}$, $R^{11}$, $R^{12}$ and $R^{14}$ represent hydrogen; and n is an integer of from 0 to about 12.

4. A photoconductive insulating element as defined in claim 2 wherein said photoconductive polymer is selected from the group consisting of

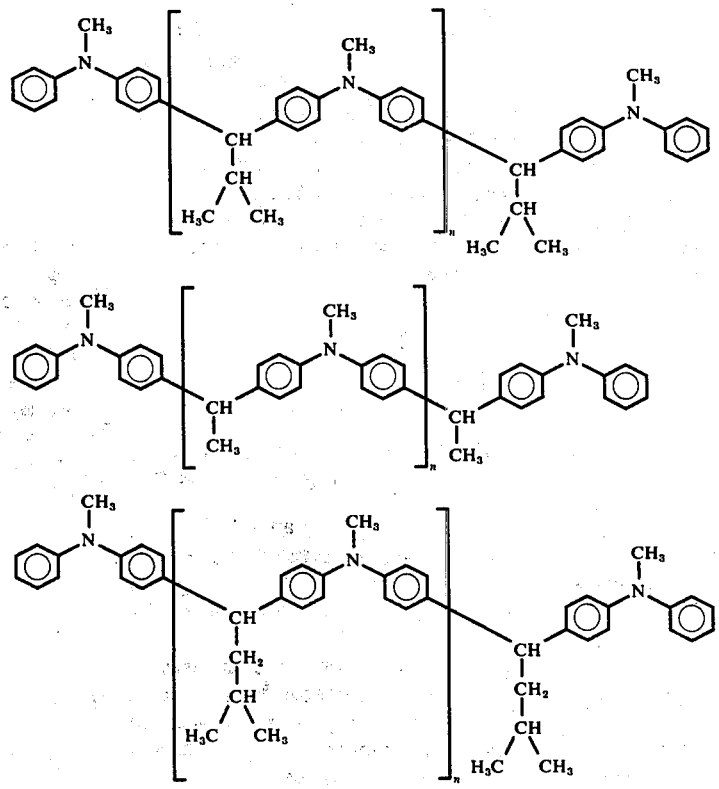

-continued

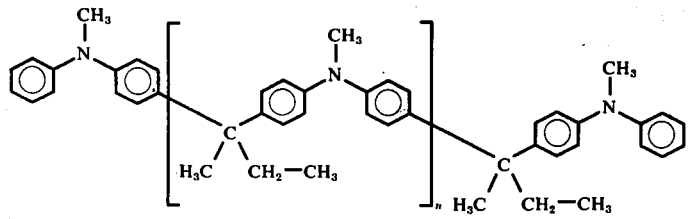

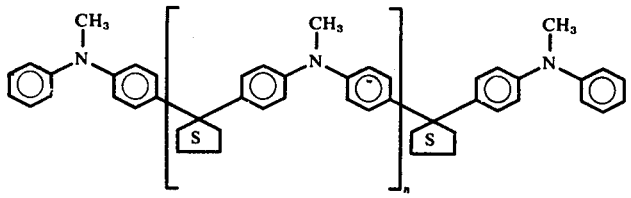

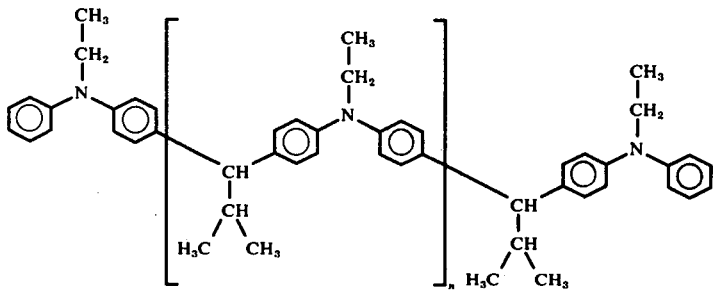

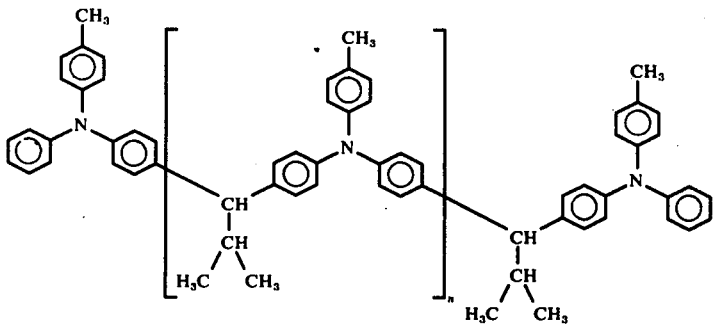

wherein $n$ is an integer of from 0 to about 12.

5. A photoconductor insulating composition comprising a condensation polymer of (a) a tertiary amine having at least 2 phenyl groups bonded to the amine atom, (b) an amount of sensitizer effective to sensitize said composition and (c) a carbonyl-containing compound having the formula:

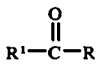

wherein $R^1$ represents a member selected from the group consisting of hydrogen, alkyl group or an aryl group;

R represents an alkyl or aryl group; and $R^1$ and R, when taken together, represent the carbon atoms necessary to complete a cycloalkyl group containing 4 to about 8 carbon atoms in the cycloalkyl ring.

6. In an electrophotographic element comprising a conductive support and a photoconductive layer coated over said support, the improvement wherein said photoconductive layer comprises the photoconductive insulating composition of claim 5.

7. In an electrophotographic process wherein an electrostatic charge pattern is formed by a photoconductive element comprised of an electrically conducting support having coated thereover a layer of a photoconductive insulating composition, the improvement wherein said photoconductive insulating composition is as described in claim 5.

8. A photoconductive insulating composition comprising an electrically insulating, film forming polymeric binder, a photoconductive polymer, and an amount of sensitizer effective to sensitive said composition, said photoconductive polymer having the formula

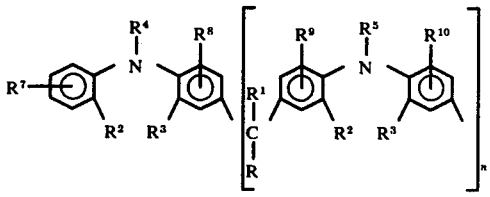

-continued

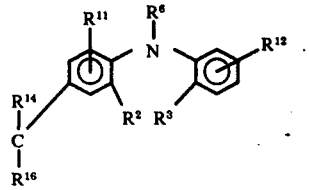

wherein n represents an integer of from 0 to about 20;

$R^2$ and $R^3$ each represent hydrogen or, when taken together, $R^2$ and $R^3$ represent a chemical bond which completes a carbazole nucleus:

$R^4$, $R^5$ and $R^6$, which may be the same or different, each represent a member selected from the group consisting of a substituted or unsubstituted alkyl or aryl group, said substituted alkyl group having a substituent selected from the group consisting of an alkoxy, aryloxy, amino, hydroxy, alkylamino, aryl, arylamino, nitro, cyano, or a halogen group, said substituted aryl group having a substituent selected from the group consisting of an alkoxy, aryloxy, amino, hydroxy, alkylamino, arylamino, nitro, cyano, halogen, or an alkyl group;

$R^7$, $R^8$, $R^9$, $R^{10}$, $R^{11}$ and $R^{12}$, which may be the same or different, each represent a member selected from the group consisting of hydrogen, the substituted and unsubstituted alkyl and aryl groups as defined for $R^4$, $R^5$ and $R^6$, an alkoxy group, aryloxy group, halogen, nitro group, cyano group, amino group, or an acyl group;

$R^1$ and $R^{14}$, which may be the same or different, each represent a member selected from the group consisting of hydrogen of the substituted and unsubstituted alkyl and aryl groups as defined for $R^4$, $R^5$ and $R^6$;

R and $R^{16}$, which may be the same or different, each represent a member selected from the substituted and unsubstituted alkyl and aryl groups defined for $R^4$, $R^5$ and $R^6$; with the proviso that, when taken together, $R^1$ and R or $R^{14}$ and $R^{16}$ represent the carbon atoms necessary to complete a cycloalkyl group containing 3 to about 21 carbon atoms in the cycloalkyl ring.

9. A photoconductive insulating composition as defined in claim 8 wherein R and $R^{16}$ each represent an usubstituted alkyl group having 1 to about 8 carbon atoms; $R^4$, $R^5$ and $R^6$ each represent a member selected from the group consisting of an unsubstituted phenyl group, an alkylsubstituted phenyl group having 1 to about 3 carbon atoms in the alkyl substituent, or an unsubstituted alkyl group having 1 to 4 carbon atoms in the alkyl group; $R^1$, $R^2$, $R^3$, $R^7$, $R^8$, $R^9$, $R^{10}$, $R^{11}$, $R^{12}$ and $R^{14}$ represent hydrogen; and n is an integer of from 0 to about 12.

10. A photoconductive insulating composition as defined in claim 8 wherein said sensitizer is present in an amount of from about 0.005 to about 10 percent by weight of said composition and said photoconductive polymer is present in an amount of from about 15 to about 90 percent by weight of said composition.

11. A photoconductive insulating composition as defined in claim 8 wherein said composition is a homogeneous composition having said photoconductive polymer in solid solution with said polymeric binder.

12. In an electrophotographic element comprising a conductive support and a photoconductive layer coated over said support, the improvement wherein said photoconductive layer comprises the photoconductive insulating composition of claim 7.

13. A homogeneous photoconductive insulating composition comprising an electrically insulating, film forming polymeric binder, a photoconductive polymer in an amount equal to at least about 15 percent by weight of said composition, and a sensitizer for said composition in an amount within the range of from about 0.005 to about 10 percent by weight of said composition, said photoconductive polymer in solid solution with said binder and having the formula

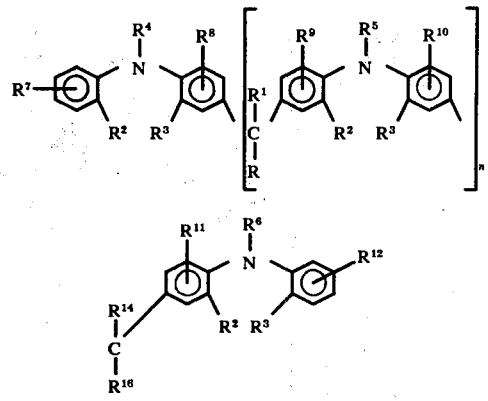

wherein

*n* represents an integer of from 0 to about 20;

$R^2$ and $R^3$ each represent hydrogen or, when taken together, $R^2$ and $R^3$ represent a chemical bond which completes a carbazole nucleus;

$R^4$, $R^5$ and $R^6$, which may be the same or different, each represent a member selected from the group consisting of a substituted or unsubstituted alkyl or aryl group, said substituted alkyl group having a substituent selected from the group consisting of an alkoxy, aryloxy, amino, hydroxy, alkylamino, aryl, arylamino, nitro, cyano or a halogen group, said substituted aryl group having a substituent selected from the group consisting of an alkoxy, aryloxy, amino, hydroxy, alkylamino, arylamino, nitro, cyano, halogen, or an alkyl group;

$R^7$, $R^8$, $R^9$, $R^{10}$, $R^{11}$ and $R^{12}$, which may be the same or different, each represent a member selected from the group consisting of hydrogen, the substituted and unsubstituted alkyl and aryl groups as defined for $R^4$, $R^5$ and $R^6$, an alkoxy group, an aryloxy group, a halogen, a nitro group, a cyano group, an amino group, or an acyl group;

$R^1$ and $R^{14}$, which may be the same or different, each represent a member selected from the group consisting of hydrogen and the substituted and unsubstituted alkyl and aryl groups defined for $R^4$, $R^5$ and $R^6$;

R and $R^{16}$, which may be the same or different, each represent a member selected from the substituted and unsubstituted alkyl and aryl groups defined for $R^4$, $R^5$ and $R^6$; with the proviso that, when taken together, $R^1$ and R or $R^{14}$ and $R^{16}$ represent the carbon atoms necessary to complete a cycloalkyl group containing 3 to about 21 carbon atoms in the cycloalkyl ring.

14. A homogeneous photoconductive insulating composition as defined in claim 13 wherein said photoconductive polymer is selected from the group consisting of
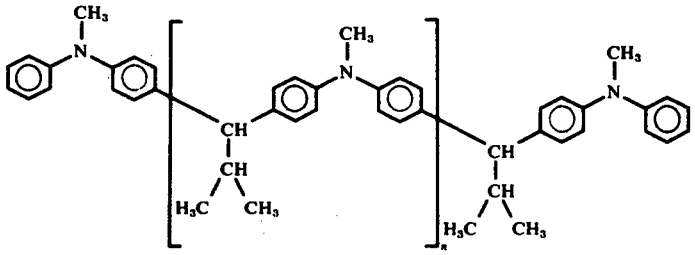
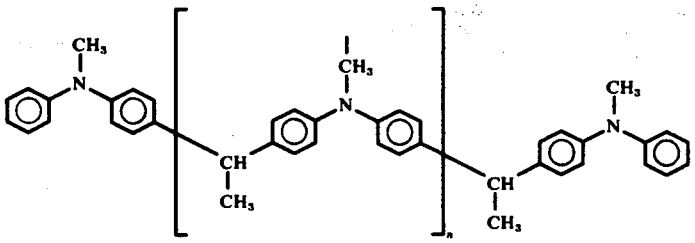
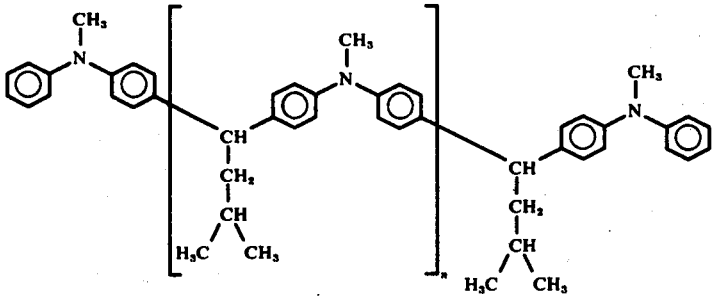
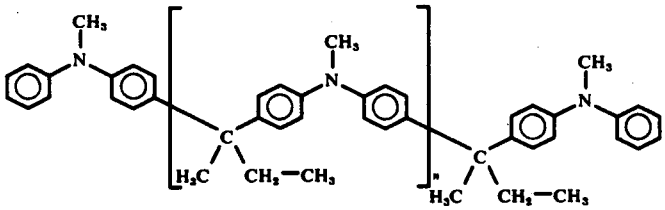
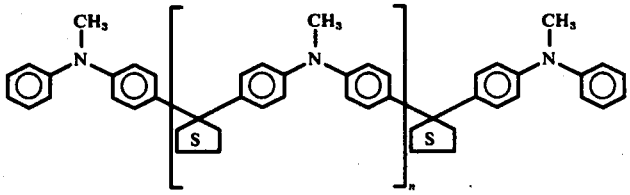
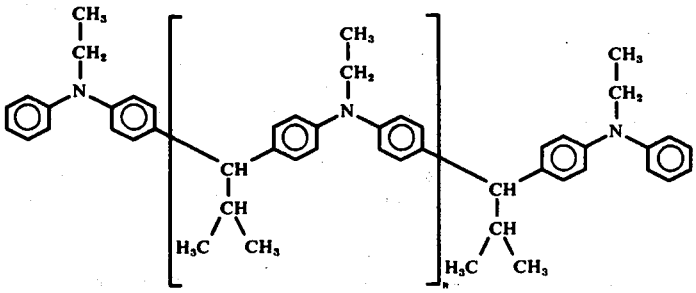

-continued

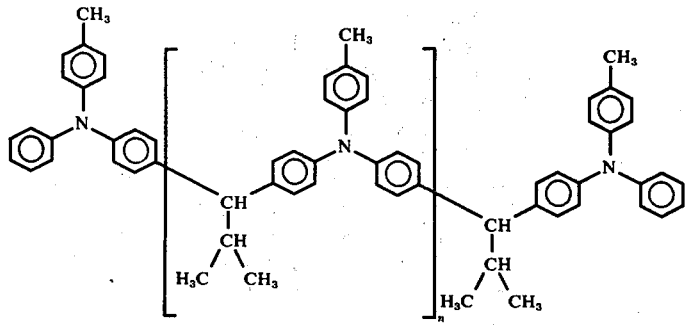

wherein $n$ is an integer of from 0 to about 12.

15. An aggregate photoconductive insulating composition comprising a continuous, electrically insulating binder phase containing (a) dissolved therein one or more photoconductive polymers and (b) dispersed therein a particulate, cocrystalline complex of (1) a pyrylium-type dye salt and (2) a polymer having an alkylidene diarylene group in a recurring unit thereof, at least one of said photoconductive polymers having the formula:

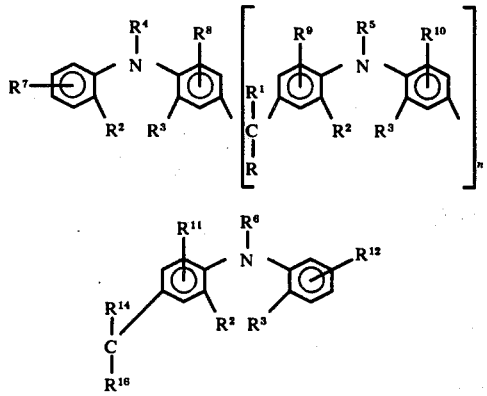

wherein:

$n$ represents an integer of from 0 to about 20;

each of $R^2$ and $R^3$ represents hydrogen or, when taken together, $R^2$ and $R^3$ represent a chemical bond which completes a carbazole nucleus;

each of $R^4$, $R^5$ and $R^6$, which may be the same or different, represents a member selected from the group consisting of a substituted or unsubstituted alkyl or aryl group, said substituted alkyl group having a substituent selected from the group consisting of an alkoxy, aryloxy, amino, hydroxy, alkylamino, aryl, arylamino, nitro, cyano or a halogen group, said substituted aryl group having a substituent selected from the group consisting of an alkoxy, aryloxy, amino, hydroxy, alkylamino, arylamino, nitro, cyano, halogen or an alkyl group;

each of $R^7$, $R^8$, $R^9$, $R^{10}$, $R^{11}$ and $R^{12}$, which may be the same or different, represents a member selected from the group consisting of hydrogen, the substituted and unsubstituted alkyl and aryl groups as defined for $R^4$, $R^5$ and $R^6$, an alkoxy group, aryloxy groups, halogen, nitro group, cyano group, amino group or an acyl group;

each of $R^1$ and $R^{14}$, which may be the same or different, represents a member selected from the group consisting of hydrogen and the substituted and unsubstituted alkyl and aryl groups defined for $R^4$, $R^5$ and $R^6$; and each of R and $R^{16}$, which may be the same or different, represents a member selected from the substituted and unsubstituted alkyl and aryl groups defined for $R^4$, $R^5$ and $R^6$;

with the proviso that, when taken together, $R^1$ and R or $R^{14}$ and $R^{16}$ represent the carbon atoms necessary to complete a cycloalkyl group containing 3 to about 21 carbon atoms in the cycloalkyl ring.

16. An aggregate photoconductive insulating composition as defined in claim 15 wherein said dye salt is a 2,4,6-substituted thiapyrylium dye salt, R and $R^{16}$ each represent an unsubstituted alkyl group having 1 to about 8 carbon atoms; $R^4$, $R^5$ and $R^6$ each represent a member selected from the group consisting of an unsubstituted phenyl group, an alkyl-substituted phenyl group having 1 to about 3 carbon atoms in the alkyl substituent, or an unsubstituted alkyl group having 1 to 4 carbon atoms in the alkyl group; $R^1$, $R^2$, $R^3$, $R^7$, $R^8$, $R^9$, $R^{10}$ $R^{11}$, $R^{12}$ and $R^{14}$ represent hydrogen; and n is an integer of from 0 to about 12.

17. In an electrophotographic element comprising a conductive support and a photoconductive layer coated over said support, the improvement wherein said photoconductive layer comprises the photoconductive insulating composition of claim 15.

18. An aggregate photoconductive insulating composition comprising a continuous, electrically insulating binder phase containing (a) dissolved therein one or more photoconductive polymers and (b) dispersed therein a particulate, co-crystalline complex of (1) a thiapyrylium dye salt and (2) a polycarbonate containing an alkylidene diarylene group in the recurring unit thereof, at least one of said photoconductive polymers having the formula:

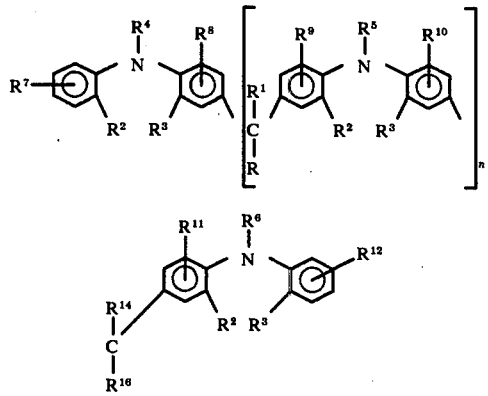

wherein:

*n* represents an integer of from 0 to about 20;

each of $R^2$ and $R^3$ represents hydrogen or, when taken together, $R^2$ and $R^3$ represent a chemical bond which completes a carbazole nucleus;

each of $R^4$, $R^5$ and $R^6$, which may be the same or different, represents a member selected from the group consisting of a substituted or unsubstituted alkyl or aryl group, said substituted alkyl group having a substituent selected from the group consisting of an alkoxy, aryloxy, amino, hydroxy, alkylamino, aryl, arylamino, nitro, cyano or a halogen group, said substituted aryl group having a substituent selected from the group consisting of an alkoxy, aryloxy, amino, hydroxy, alkylamino, arylamino, nitro, cyano, halogen or alkyl group;

each of $R^7$, $R^8$, $R^9$, $R^{10}$, $R^{11}$ and $R^{12}$, which may be the same or different, represents a member selected from the group consisting of hydrogen, the substituted and unsubstituted alkyl and aryl groups as defined for $R^4$, $R^5$ and $R^6$, an alkoxy group, an aryloxy group, a halogen, a nitro group, a cyano group, an amino group or an acyl group; each of $R^1$ and $R^{14}$, which may be the same or different, represents a member selected from the group consisting of hydrogen and the substituted and unsubstituted alkyl and aryl groups defined for $R^4$, $R^5$ and $R^6$; and each of R and $R^{16}$, which may be the same or different, represents a member selected from the substituted and unsubstituted alkyl and aryl groups defined for $R^4$, $R^5$ and $R^6$;

with the proviso that, when taken together, $R^1$ and R or $R^{14}$ and $R^{16}$ represent the carbon atoms necessary to complete a cycloalkyl group containing 3 to about 21 carbon atoms in the cycloalkyl ring.

19. An aggregate photoconductive insulating composition as defined in claim 18 wherein R and $R^{16}$ represent a member selected from the group consisting of an unsubstituted alkyl group having 1 to about 8 carbon atoms; $R^4$, $R^5$ and $R^6$ each represent a member selected from the group consisting of an unsubstituted phenyl group, an alkyl-substituted phenyl group having 1 to about 3 carbon atoms in the alkyl substituent, or an unsubstituted alkyl group having 1 to 4 carbon atoms in the alkyl group; $R^1$, $R^2$, $R^3$, $R^7$, $R^8$, $R^9$, $R^{10}$, $R^{11}$, $R^{12}$ and $R^{14}$ represent hydrogen; and n is an integer of from 0 to about 12.

20. An aggregate photoconductive insulating composition as defined in claim 18 wherein at least one of said photoconductive polymers is selected from the group consisting of

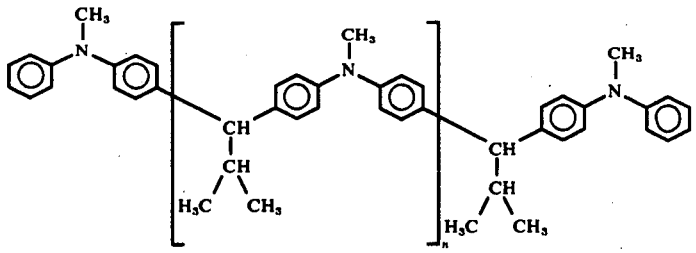

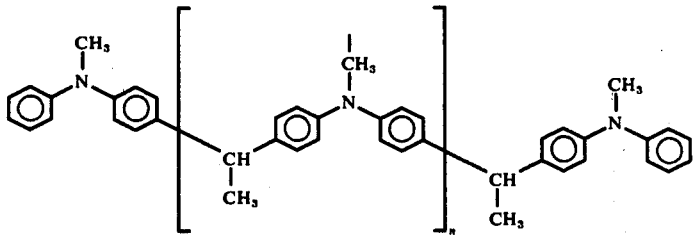

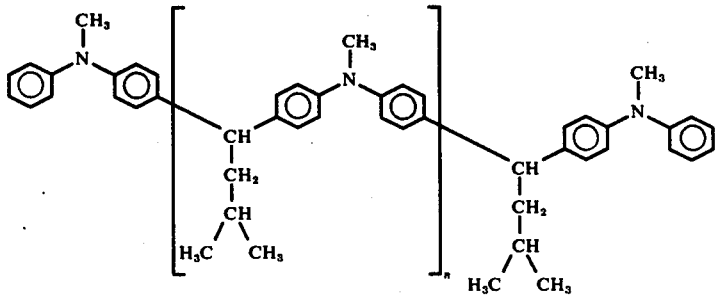

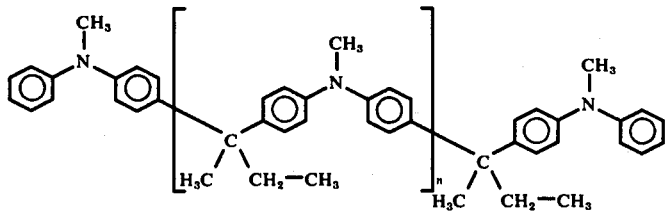

-continued
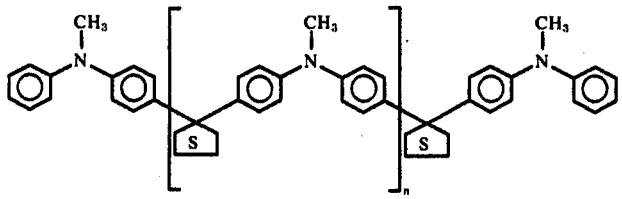
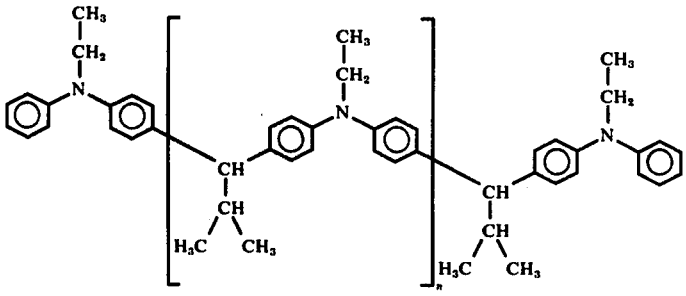
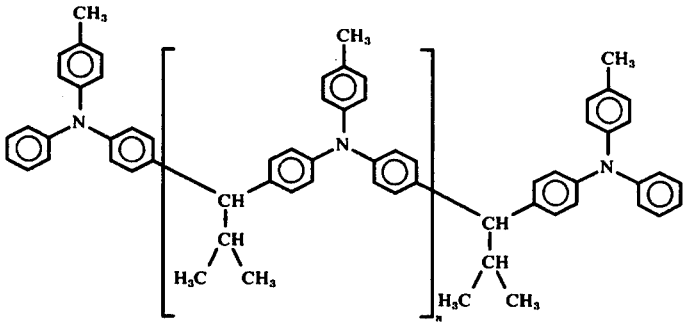
wherein $n$ is an integer of from 0 to about 12.
* * * * *

UNITED STATES PATENT AND TRADEMARK OFFICE

CERTIFICATE OF CORRECTION

PATENT NO. : 4,025,341

DATED : May 24, 1977

INVENTOR(S) : Norman G. Rule

It is certified that error appears in the above-identified patent and that said Letters Patent are hereby corrected as shown below:

Column 34, line 3, "7" should read --8--.

Signed and Sealed this

*Twenty-seventh* Day of *December 1977*

[SEAL]

*Attest:*

RUTH C. MASON
*Attesting Officer*

LUTRELLE F. PARKER
*Acting Commissioner of Patents and Trademarks*